US010829262B2

(12) United States Patent
Sill et al.

(10) Patent No.: US 10,829,262 B2
(45) Date of Patent: Nov. 10, 2020

(54) FOOD CARTON

(71) Applicant: Inno-Pak, LLC, Delaware, OH (US)

(72) Inventors: Jonathan D. Sill, Delaware, OH (US); Steven A. Mayer, Indianapolis, IN (US)

(73) Assignee: Inno-Pak, LLC, Delaware, OH (US)

( * ) Notice: Subject to any disclaimer, the term of this patent is extended or adjusted under 35 U.S.C. 154(b) by 0 days.

(21) Appl. No.: 16/388,530

(22) Filed: Apr. 18, 2019

(65) Prior Publication Data

US 2019/0322409 A1 Oct. 24, 2019

Related U.S. Application Data

(60) Provisional application No. 62/660,495, filed on Apr. 20, 2018.

(51) Int. Cl.

| | |
|---|---|
| ***B65D 5/20*** | (2006.01) |
| ***B65D 5/50*** | (2006.01) |
| ***B65D 5/54*** | (2006.01) |
| ***B65D 5/24*** | (2006.01) |
| ***B65D 5/56*** | (2006.01) |

(52) U.S. Cl.

CPC ..... *B65D 5/2061* (2013.01); *B65D 5/241* (2013.01); *B65D 5/5021* (2013.01); *B65D 5/545* (2013.01); *B65D 5/563* (2013.01)

(58) Field of Classification Search

CPC .... B65D 5/2061; B65D 5/241; B65D 5/5021; B65D 5/545; B65D 5/563; B65D 5/2047; B65D 5/2057; B65D 5/247; B65D 5/6605; B65D 2571/00148; B65D 5/6644

USPC ..... 229/105, 155, 186, 904, 114, 120.08, 229/160.2, 179, 902; 206/562, 763; D9/431

See application file for complete search history.

(56) References Cited

U.S. PATENT DOCUMENTS

| | | | |
|---|---|---|---|
| D73,127 | S | 7/1927 | Greve |
| 2,019,870 | A | 11/1935 | Perry |
| 2,062,949 | A | 12/1936 | Taylor |
| D106,826 | S | 11/1937 | Dieffenbach |

(Continued)

OTHER PUBLICATIONS

Amazon.com, "50 Paper Food to Go Containers—51oz—New Design with Waist Seal Band—Eco Friendly Disposable Kraft Paper Take Out Food Container—Sturdy Leak & Grease Proof Microwavable Take Away Boxes", retrieved from web on Nov. 5, 2019, available on https://www.amazon.com/Paper-Food-Containers-Disposable-Microwavable/dp/B07M74VWXW, 6 pages.

(Continued)

*Primary Examiner* — Christopher R Demeree
(74) *Attorney, Agent, or Firm* — Forrest Firm, P.C.

(57) ABSTRACT

A food carton including a one or more removable closure flaps. In various embodiments the food carton may include a bottom panel; side panels extending about a periphery of the bottom panel; corner gussets extending between adjacent side panels, wherein the bottom panel, side panels, and corner gussets may be configurable to form a compartment region; and one or more closure flaps extending from an uppermost edge of one or more of the side panels forming a moveable joint where the closure flap and corresponding side panel intersect, wherein one or more of the one or more closure flaps may be removable along its respective moveable joint.

19 Claims, 21 Drawing Sheets

(56) References Cited

U.S. PATENT DOCUMENTS

D126,123 S 3/1941 Clemens
2,341,762 A * 2/1944 Conklin ..... B65D 5/247 229/117.14
2,355,729 A * 8/1944 Inman ..... B65D 5/64 229/117.14
2,409,736 A 10/1946 Caimi
2,475,294 A * 7/1949 Rafoth ..... B65D 5/6685 229/401
D158,362 S 5/1950 Dischler
2,568,170 A 9/1951 Ringler
2,793,801 A 5/1957 Papadopoulos
D183,716 S 10/1958 Burns
2,927,502 A 3/1960 Watrous
3,027,063 A 3/1962 Zastrow
D194,246 S 12/1962 Engelmann
D200,249 S 2/1965 Hancock
D211,564 S 7/1968 Bailey
D214,523 S 6/1969 Stone
D217,441 S 5/1970 Kanaga
D219,263 S 11/1970 Castelli et al.
3,595,425 A 7/1971 Eicholtz et al.
3,640,380 A * 2/1972 Huffman ..... A47J 47/14 206/549
D224,090 S 7/1972 Cyr et al.
D232,524 S 8/1974 Schy
3,853,220 A 12/1974 Luray
D241,016 S 8/1976 Reynold
D255,011 S 5/1980 Cooper et al.
D259,615 S 6/1981 Morris, Jr.
D260,604 S 9/1981 Otto
D280,290 S 8/1985 Bakus
4,846,398 A * 7/1989 Johnson ..... B65D 5/247 229/143
D329,376 S 9/1992 Burd
5,226,588 A * 7/1993 Schramm ..... B65D 5/244 229/141
5,322,182 A 6/1994 Fritz
D352,203 S 11/1994 Campbell et al.
5,411,204 A 5/1995 DeMay
D363,856 S 11/1995 Westbrooks, Jr.
D367,172 S 2/1996 Brightbill et al.
D371,940 S 7/1996 Krupa
D394,385 S 5/1998 Laughlin
D395,547 S 6/1998 Sussman
D397,294 S 8/1998 Saulas
D398,526 S 9/1998 Schwarz et al.
5,873,220 A 2/1999 Haraldsson et al.
D409,908 S 5/1999 Besana
D412,398 S 8/1999 Watabe
D440,118 S 4/2001 Claffy et al.
D442,859 S 5/2001 Hirschey
D444,703 S 7/2001 Allasia
D448,130 S 9/2001 Wagner
D451,769 S 12/2001 Stanos et al.
D454,495 S 3/2002 Bryan et al.
D460,689 S 7/2002 Robinson
D461,406 S 8/2002 Iacovelli
D467,798 S 12/2002 Cohon
D484,364 S 12/2003 Bailey et al.
D484,799 S 1/2004 Hoffman et al.
D495,251 S 8/2004 Zack
D497,309 S 10/2004 Nordland et al.
D504,813 S 5/2005 Chou
D509,733 S 9/2005 Jongens
D512,836 S 12/2005 Marnell, II
7,004,314 B2 * 2/2006 Pucillo ..... B65D 5/2057 206/217
D519,366 S 4/2006 Epstein
D519,830 S 5/2006 Yocum
D521,376 S 5/2006 Mosto
D521,862 S 5/2006 Siethoff et al.
D531,498 S 11/2006 Fluegel et al.
D542,129 S 5/2007 Moorman
D549,456 S 8/2007 Dretzka
D549,457 S 8/2007 Dretzka
D557,047 S 12/2007 Dretzka
D561,023 S 2/2008 Jacxsens
D561,408 S 2/2008 Marsh
D562,125 S 2/2008 Kienemund-Paroll
D563,673 S 3/2008 Dretzka
D567,671 S 4/2008 Say Ulin
D568,765 S 5/2008 Miles
D573,408 S 7/2008 Lovett
D576,482 S 9/2008 Debusk
D578,387 S 10/2008 Lovett
D582,268 S 12/2008 Zanaletti
D584,108 S 1/2009 Olsson
D590,596 S 4/2009 Dretzka
D595,155 S 6/2009 Larson
D596,027 S 7/2009 Kalberer
D596,448 S 7/2009 Nolan
D596,449 S 7/2009 Nolan
D596,903 S 7/2009 Willis et al.
7,565,997 B1 * 7/2009 Lim ..... B65D 71/72 229/120.08
D599,611 S 9/2009 Hoekstra
D605,896 S 12/2009 Zalewski et al.
D608,153 S 1/2010 Furlong
D615,822 S 5/2010 Klein
D622,139 S 8/2010 Marcott et al.
D630,508 S 1/2011 Hubbard, Jr. et al.
D630,885 S 1/2011 Stein
D631,741 S 2/2011 Hubbard, Jr. et al.
D631,742 S 2/2011 Hubbard, Jr. et al.
D631,743 S 2/2011 Hubbard, Jr. et al.
D633,341 S 3/2011 Smyers
D643,311 S 8/2011 Meyers
D645,708 S 9/2011 Stamper et al.
8,061,585 B2 11/2011 Nikolai et al.
D649,838 S 12/2011 Stamper et al.
D652,316 S 1/2012 Ren et al.
D653,496 S 2/2012 Henry
D669,352 S 10/2012 Paslawski
D674,690 S 1/2013 Sill
D675,092 S 1/2013 Sill
D675,520 S 2/2013 Sill
D675,920 S 2/2013 Sill
D676,742 S 2/2013 Walter et al.
D678,760 S 3/2013 Cooper
D678,761 S 3/2013 Cooper
D678,762 S 3/2013 Cooper
D678,779 S 3/2013 Lee
D679,950 S 4/2013 Cooper
D682,085 S 5/2013 Hannant et al.
D682,684 S 5/2013 Walter et al.
D684,465 S 6/2013 Vernon et al.
D684,858 S 6/2013 Sill
D688,552 S 8/2013 Vernon et al.
D688,921 S 9/2013 Miros et al.
D691,035 S 10/2013 Sill
D693,180 S 11/2013 Peterson et al.
D693,215 S 11/2013 Sill
D693,216 S 11/2013 Sill
D693,217 S 11/2013 Sill
D693,218 S 11/2013 Sill
D693,646 S 11/2013 Katterheinrich et al.
D693,679 S 11/2013 Sill
D695,101 S 12/2013 Keberlein et al.
D695,104 S 12/2013 Sill
D695,107 S 12/2013 Clements
D695,575 S 12/2013 Katz
D695,605 S 12/2013 Johnson
D697,789 S 1/2014 Gerdes et al.
D706,132 S 6/2014 Sill
D707,042 S 6/2014 Ruzzenente
D707,123 S 6/2014 Marchetti et al.
D710,691 S 8/2014 Genender
D712,153 S 9/2014 Lee
D714,638 S 10/2014 Mohn et al.
8,939,350 B2 1/2015 Valencia
D726,533 S 4/2015 Northrup
D727,732 S 4/2015 Petty
D728,359 S 5/2015 Iwegbu

(56) References Cited

U.S. PATENT DOCUMENTS

| | | | | |
|---|---|---|---|---|
| D728,364 | S | 5/2015 | Baker et al. | |
| D730,178 | S | 5/2015 | Fullan | |
| D731,325 | S | 6/2015 | Loessin | |
| D735,576 | S | 8/2015 | Aldridge | |
| D737,820 | S | 9/2015 | Yu et al. | |
| 9,211,970 | B2 | 12/2015 | Hubbard, Jr. et al. | |
| 9,212,842 | B2 * | 12/2015 | Vasbinder | F25D 3/08 |
| 9,216,837 | B2 | 12/2015 | Hubbard et al. | |
| D746,643 | S | 1/2016 | Kraemer | |
| D752,429 | S | 3/2016 | Mayer | |
| 9,309,023 | B2 | 4/2016 | Hubbard, Jr. et al. | |
| D758,184 | S | 6/2016 | Tu et al. | |
| D763,706 | S | 8/2016 | Shum et al. | |
| D764,276 | S | 8/2016 | Das et al. | |
| D764,281 | S | 8/2016 | Mayer | |
| D767,409 | S | 9/2016 | Nickell | |
| D770,270 | S | 11/2016 | Mcgarry et al. | |
| D771,486 | S | 11/2016 | Mayer | |
| D772,053 | S | 11/2016 | Mayer | |
| D775,946 | S | 1/2017 | Ghini et al. | |
| D776,548 | S * | 1/2017 | Bell | D9/753 |
| D777,029 | S | 1/2017 | Stratton | |
| D778,115 | S | 2/2017 | Strachan | |
| D778,155 | S | 2/2017 | Strachan | |
| D778,722 | S | 2/2017 | Strachan | |
| D784,769 | S | 4/2017 | Beckman et al. | |
| D786,621 | S | 5/2017 | Davis | |
| D792,160 | S | 7/2017 | Ng | |
| D792,161 | S | 7/2017 | Ng | |
| D792,211 | S | 7/2017 | Foster et al. | |
| D792,222 | S | 7/2017 | Sill et al. | |
| D792,761 | S | 7/2017 | Duval et al. | |
| D798,707 | S | 10/2017 | Mayer | |
| 10,017,290 | B2 | 7/2018 | Faulkner et al. | |
| 2002/0108955 | A1 | 8/2002 | Erb | |
| 2003/0217946 | A1 | 11/2003 | Hsu | |
| 2004/0182916 | A1 | 9/2004 | Roseth | |
| 2005/0051461 | A1 | 3/2005 | Bryant | |
| 2005/0150788 | A1 | 7/2005 | Feusner | |
| 2007/0074993 | A1 * | 4/2007 | Philips | B65D 75/38 206/562 |
| 2008/0269034 | A1 | 10/2008 | Stier | |
| 2009/0186132 | A1 | 7/2009 | Mangino et al. | |
| 2010/0065620 | A1 | 3/2010 | Smith | |
| 2011/0240653 | A1 | 10/2011 | Castner et al. | |
| 2012/0234904 | A1 | 9/2012 | Costanzo, Jr. | |
| 2014/0203070 | A1 | 7/2014 | Lee | |
| 2014/0263353 | A1 | 9/2014 | Bell | |
| 2014/0263600 | A1 | 9/2014 | Valencia | |
| 2016/0107830 | A1 | 4/2016 | Baryshyan | |

OTHER PUBLICATIONS

WebstaurantStore.com, "Choice 7 ¾"×5 ½"×2" Kraft Microwavable Folded Paper #2 Take-Out Container—200/Case", retrieved from web on Nov. 5, 2019, available on https://www.webstaurantstore.com/choice-8-1-2-x-6-x-2-kraft-microwavable-folded-paper-2-take-out-container-case/795PTOKFT2.html, 6 pages.

WestRock, "Fold-Pak—Bio-Plus Earth", retrieved from web on Nov. 5, 2019, available on http://www.fold-pak.com/products/Bio-PlusEarth.htm, 2 pages.

Alibaba.com, "Black Disposable Divided Food Trays", Oct. 17, 2013, [earliest online date], [site visited Apr. 3, 2017]. Available from Internet, <URL:https://thai.alibaba.com/product-detail/black-disposable-divided-food-trays-plastic-1238104653.html>. 9 pages.

Flex Active Sports, "Buy 3-Compartment Food Prep Containers", Jan. 5, 2016, [earliest online date], [site visited Apr. 17, 2017]. Available from Internet, <URL:http://flexactivesports.com/buy-3-compartment-food-prep-containers/>. 14 pages.

Webstaurant Store, "Cambro 9113CW414 Camwear Teal 9"×11" 3 Compartment Meal Delivery Tray", [earliest online date], [site visited Apr. 17, 2017]. Available from Internet, <URL: https://www.webstaurantstore.com/cambro-9113cw414-camwear-teal-9-x-11-3-compartment-meal-delivery-tray-case/2149113CWTE.html>. Mar. 14, 2010, 4 pages.

"Curved lid box", Nov. 2, 2013, [earliest online date], [site visited Oct. 30, 2015]. Available from internet, <URL: http://www.robves.com/category/tags/highlight?page=3>, 1 page.

Dean Supply, "Disposable Takeout Containers", 2018, [earliest online date], [site visited Mar. 8, 2018]. Available from Internet, <URL: https://www.shopatdean.com/collections/disposable-takeout-containers-foam-paper-plastic-compostable/rectangular>, 9 pages.

"Empty candy boxes", available online Oct. 12, 2013, [site visited Oct. 30, 2015]. Available from internet, <URL: https://www.blaircandy.com/emcabo.html>, 1 page.

Amazon, "Food Containers 3 Compartment Premium", Jul. 18, 2017, [earliest online date], [site visited Mar. 8, 2018]. 9 pages.

"Kalifornia Love: Extra Fruit Sensations Sweet Watermelon", Jul. 28, 2010, [earliest online dale], [site visited Nov. 4, 2016]. Available from Internet, <URL : http://www.kalifornialove.com/2010/07/extra-fruit-sensations-sweet-watermelon.html> 20 pages.

Inno-Pak, "Innobox Edge Insert", Oct. 25, 2016, [earliest online date], [site visited Feb. 2, 2017]. 3 pages.

"Inno-Pak is Staying Put", available on Jun. 13, 2015, [online], [site visited Dec. 11, 2015]. Available from internet, <URL:https://www.delgazette.com/news/295/inno-pak-is-staying-put> 1 page.

Youtube, "Inno-Pak Rigid Microwavable Take Out Containers", Sep. 17, 2014, [earliest online date], [site visited Feb. 2, 2017]. 1 page.

"Natural Krall Windowed Boxes", Oct. 4, 2014, available Oct. 4, 2014, [online], [site visited Dec. 11, 2015]. 1 page.

"Southern Champion Tray 0731#1—Take-out Container", available on Jan. 17, 2013, [online], [site visited Oct. 30, 2015]. 1 page.

"Southern Champion Tray 0761#1", [online] Published date unknown. Retrieved on Jul. 13, 2017, 1 page.

"Southern Champion Tray 0764#1", [online] Published date unknown. Retrieved on Jul. 13, 2017, 1 page.

"Southern Champion Tray Window Bakery Box", available on Mar. 15, 2013, [online], [site visited Dec. 11, 2015]. 1 page.

Glynn, Robin "Origami treasure chest", available on Nov. 29, 2010, [online], [site visited Oct. 30, 2015]. 1 page.

Nearof, "Review: Stride Spark Vitamin Chewing Gum.", Sep. 7, 2011, 4 pages.

* cited by examiner

FOOD CARTON

RELATED APPLICATIONS

This application claims priority to and incorporates herein by reference related U.S. Provisional Patent Application No. 62/660,495 filed on Apr. 20, 2018.

TECHNICAL FIELD

The presently disclosed subject matter relates generally to a carton, and more particularly to a food carton with removable flaps, and optionally portion cup punch-outs disposed in one or more of the flaps.

BACKGROUND

Various products are known to be purchased by consumers which require a container for ease of transport. For example, in the food and grocery industry it is common to place food items in individual carry-out/to-go food containers. There are certain drawbacks to many of the currently used carry-out food containers. Often a consumer desires to eat directly out of the carry-out food container, especially while on the go, or when plates, bowels, etc. are not readily available (e.g., at work, etc.). However, most carry-out food containers have an attached lid (which may have one or more flaps), the lid can be awkwardly in the way and make accessing the food directly from the carry-out container difficult and therefor difficult to eat. Further, consumers often wish to have a condiment, e.g., sauce, dip, dressing, or other side item, e.g., garnish, topping, or the like to accompany their carry-out food item. However, many carry-out food cartons do not have a defined/separate space for a condiment or side item, so often the condiment or side item just gets placed in the carton right alongside the food. Some cartons do have an area inside of the take-out carton partially divided off for holding a condiment or side item. However, in either case, the condiment or side item can easily get mixed up with the food item during transport, and also takes up room in the take-out carton itself, thus leaving less room for the primary food item itself. Some restaurants may provide a separate container for the condiment or side item; however, this can make the carry-out carton more cumbersome and awkward to carry, because the consumer now has multiple containers to carry. Further still, it may not be convenient for the consumer to eat out of carry-out container and also have to use a separate condiment/side item container.

SUMMARY

In one embodiment, a carton, such as a food carton, is provided. The food carton may include a bottom panel; side panels extending about a periphery of the bottom panel; corner gussets extending between adjacent side panels, wherein the bottom panel, side panels, and corner gussets may be configurable to form a compartment region; and one or more closure flaps extending from an uppermost edge of one or more of the side panels forming a moveable joint where the closure flap and corresponding side panel intersect, wherein one or more of the one or more closure flaps may be removable along its respective moveable joint. The carton may further include one or more punch-out regions formed in one or more of the one or more closure flaps. The punch-out region may be sized and configured to accept and retain a portion cup therein. The punch-out region may be general circular in shape. The punch-out region may include a moveable or removable portion to allow for insertion of a portion cup into the punch-out region. The punch-out region may include two semicircle portions abutting each other along a straight edge of their respective semicircles, and each of the two semicircles may have a portion thereof attached to the closure flap, wherein one or both of the two semicircle portions may be configured to be at least one of moved or removed to allow for insertion of a portion cup into the punch-out region. The one or more of the moveable joints may be weakened and configured to allow for removal of its corresponding closure flap by a user pulling on the closure flap. The one or more of the moveable joints may include perforations. The one or more closure flaps may be configured to fold inward and downwardly into a position above and substantially parallel with the bottom panel to close the carton. The at least two of the one or more closure flaps may be adapted to engage with one another when in a folded closed position. The at least two closure flaps may be opposing closure flaps and may be configured to interlock with one another via a tab formed on one of the at least two closure flaps and a corresponding slot formed in the other of the at least two closure flaps. The closure flaps may be configured such that when in a closed position one or more of the one or more closure flaps overlap at least a portion of a portion cup inserted in one or more of the one or more portion cup punch-outs. The compartment region may be of a generally trapezoidal shape. An inner surface of the compartment region may include a coating. The coating may include a food grade plastic coating. The coating may include a heat sealable coating. The corner gussets may be configured to be foldable and securable to an inner surface of one of their adjacent side panels, wherein securing the corner gussets to their corresponding adjacent side panels secures the compartment region in its formed state. The corner gussets may be secured to the inner surface of one of their adjacent side panels by at least one of adhesive and thermal bonding. In the case of a heat sealable coating on the inner surface of the compartment region, the corner gussets may be secured to the inner surface of their corresponding adjacent side panels by applying heat to the region where the corner gussets overlap with their corresponding adjacent side panels, thereby activating the heat sealable coating. The side panels may be disposed at an obtuse angle as measured from the bottom panel, and wherein the side walls may taper along a left and right side edge of the side walls from their top edge to their bottom edge.

BRIEF DESCRIPTION OF THE DRAWINGS

Figure 1:
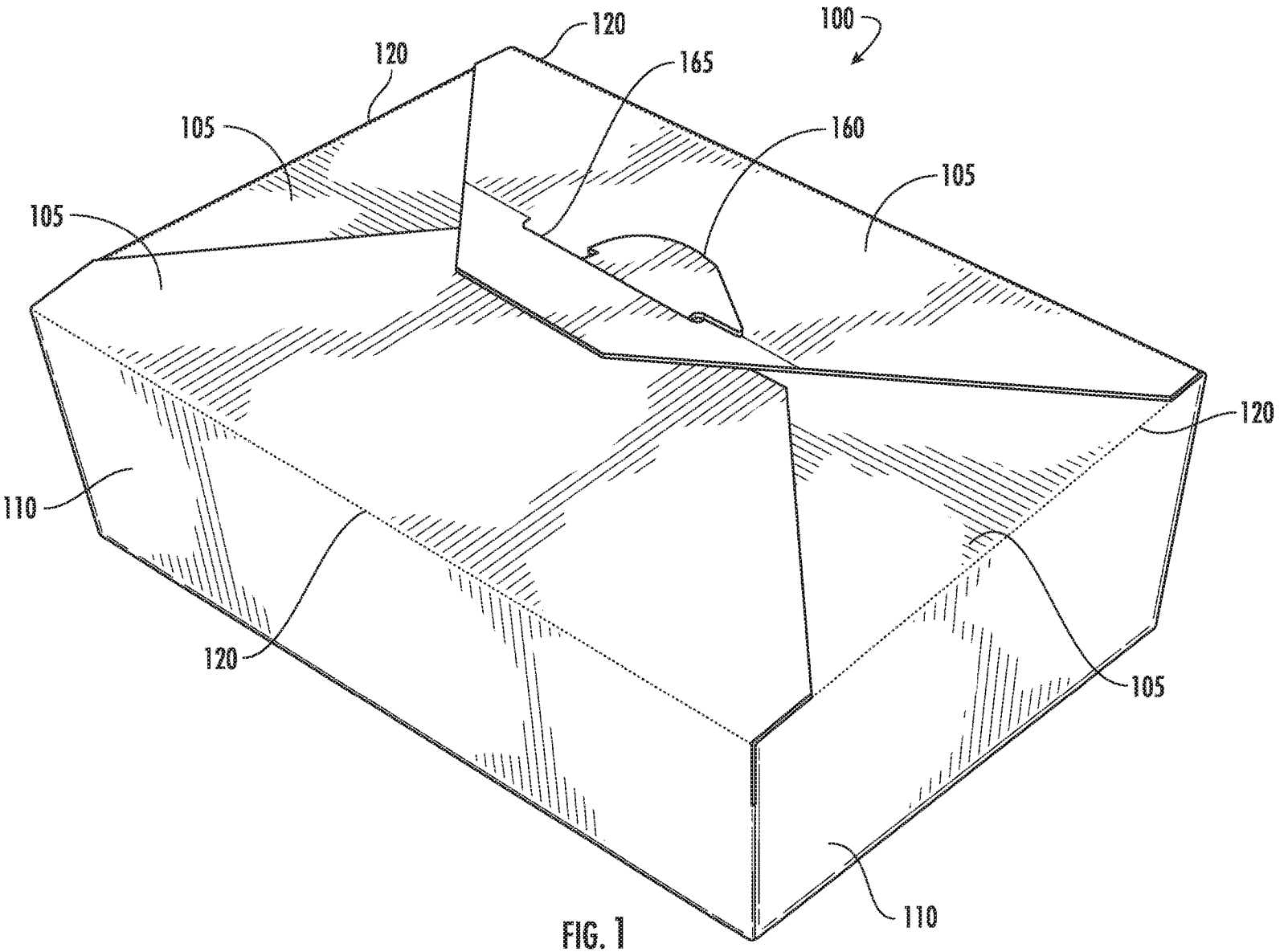
Figure 2:
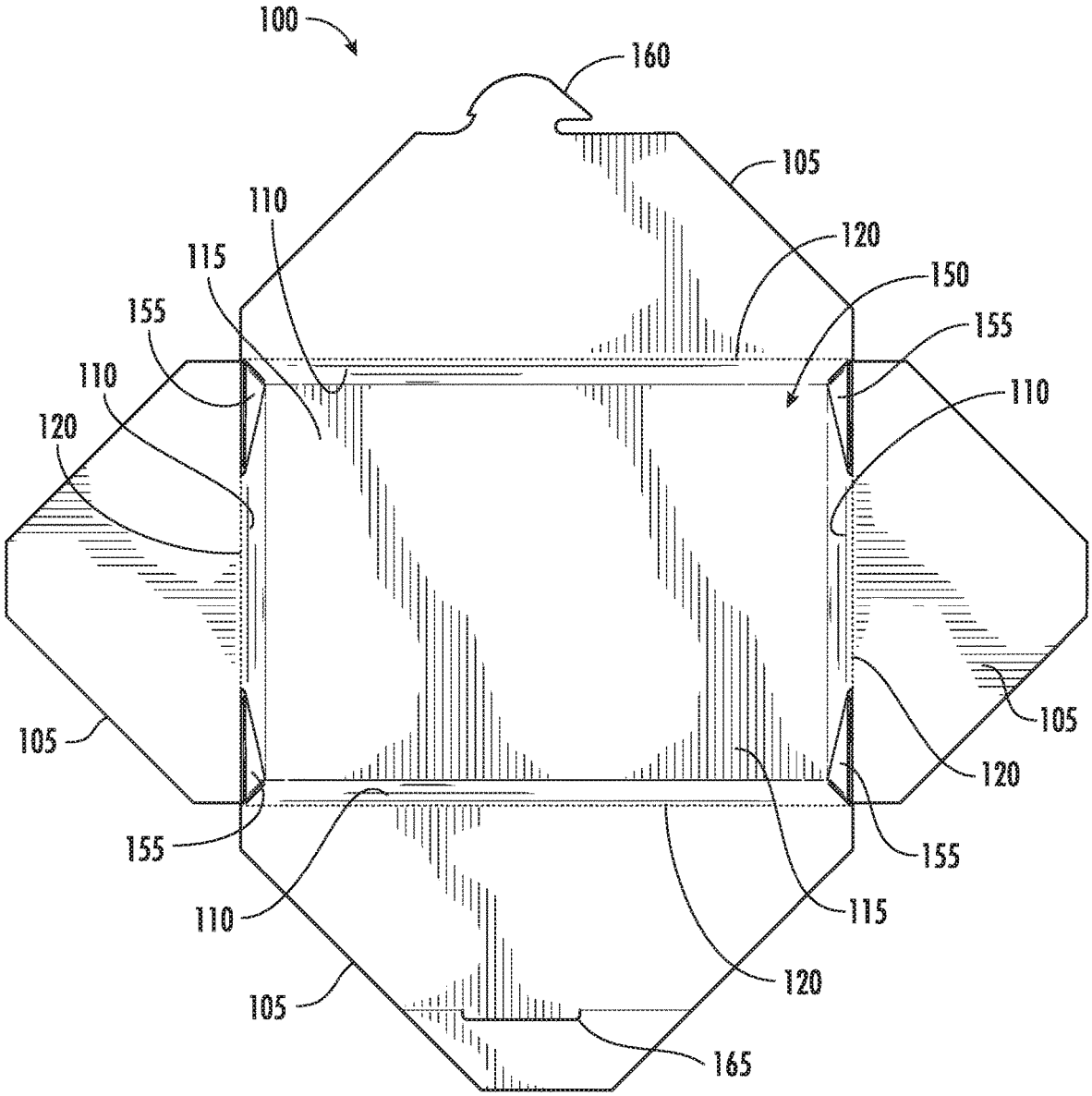
Figure 3:
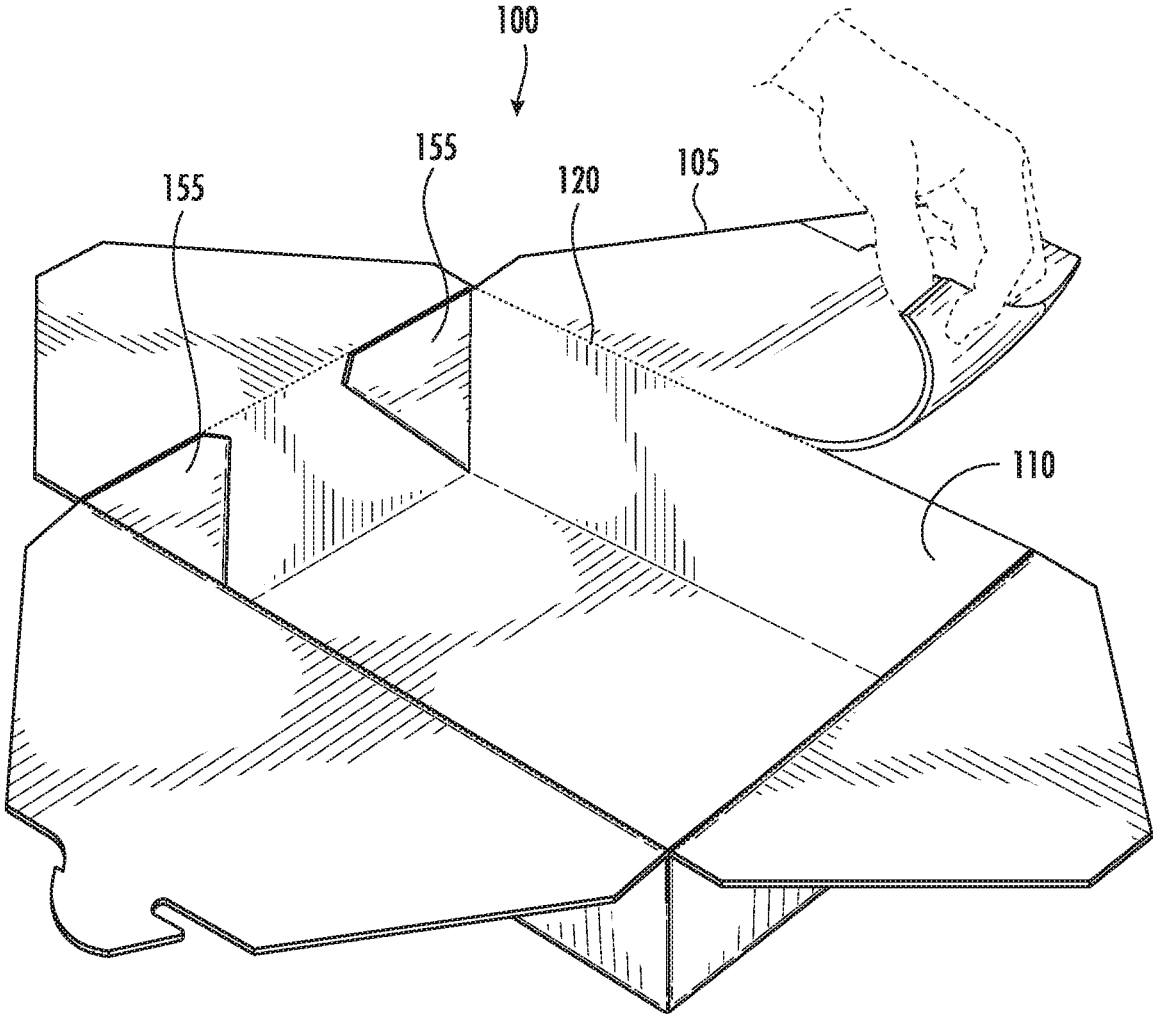
Figure 4:
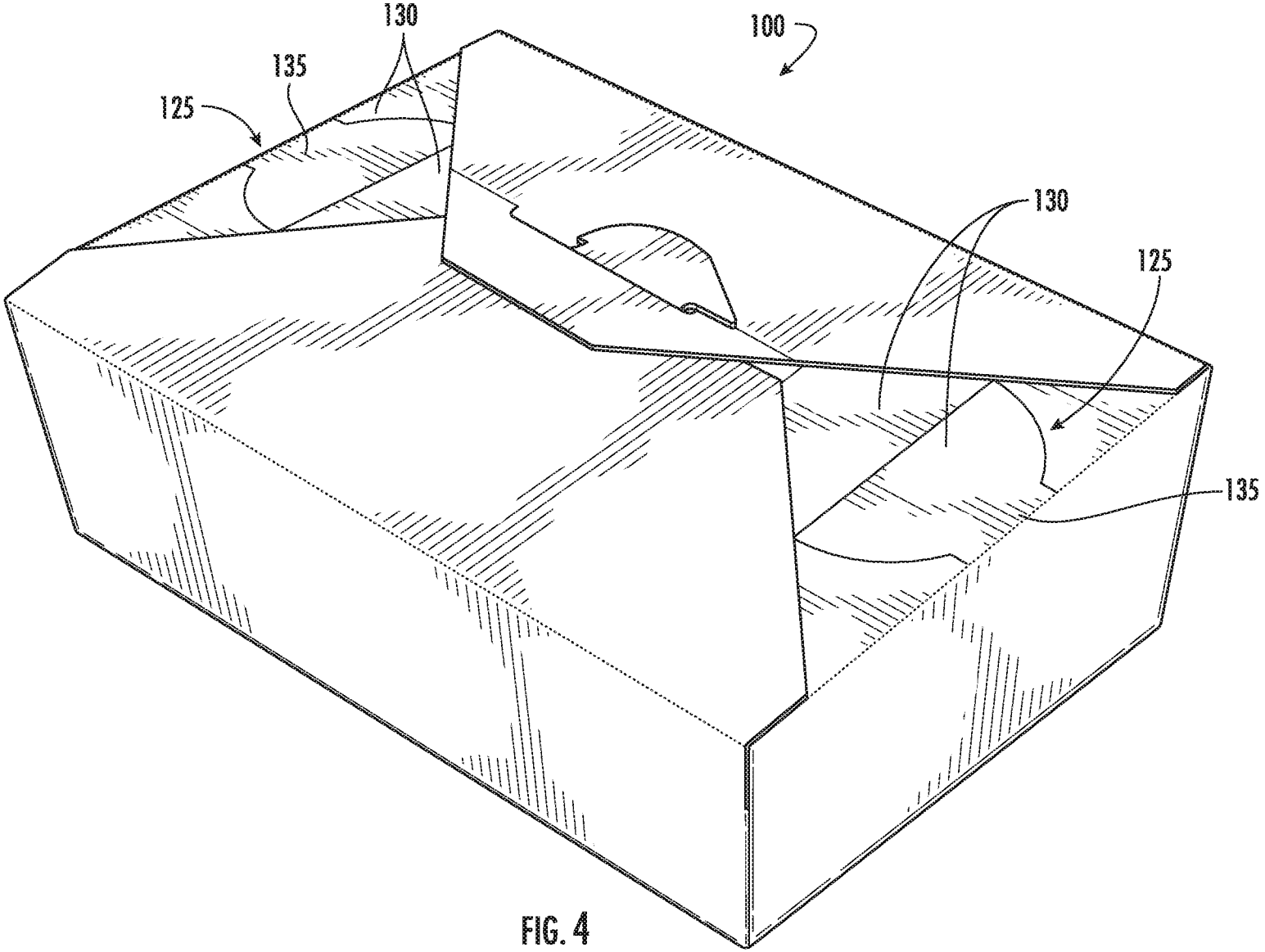
Figure 5:
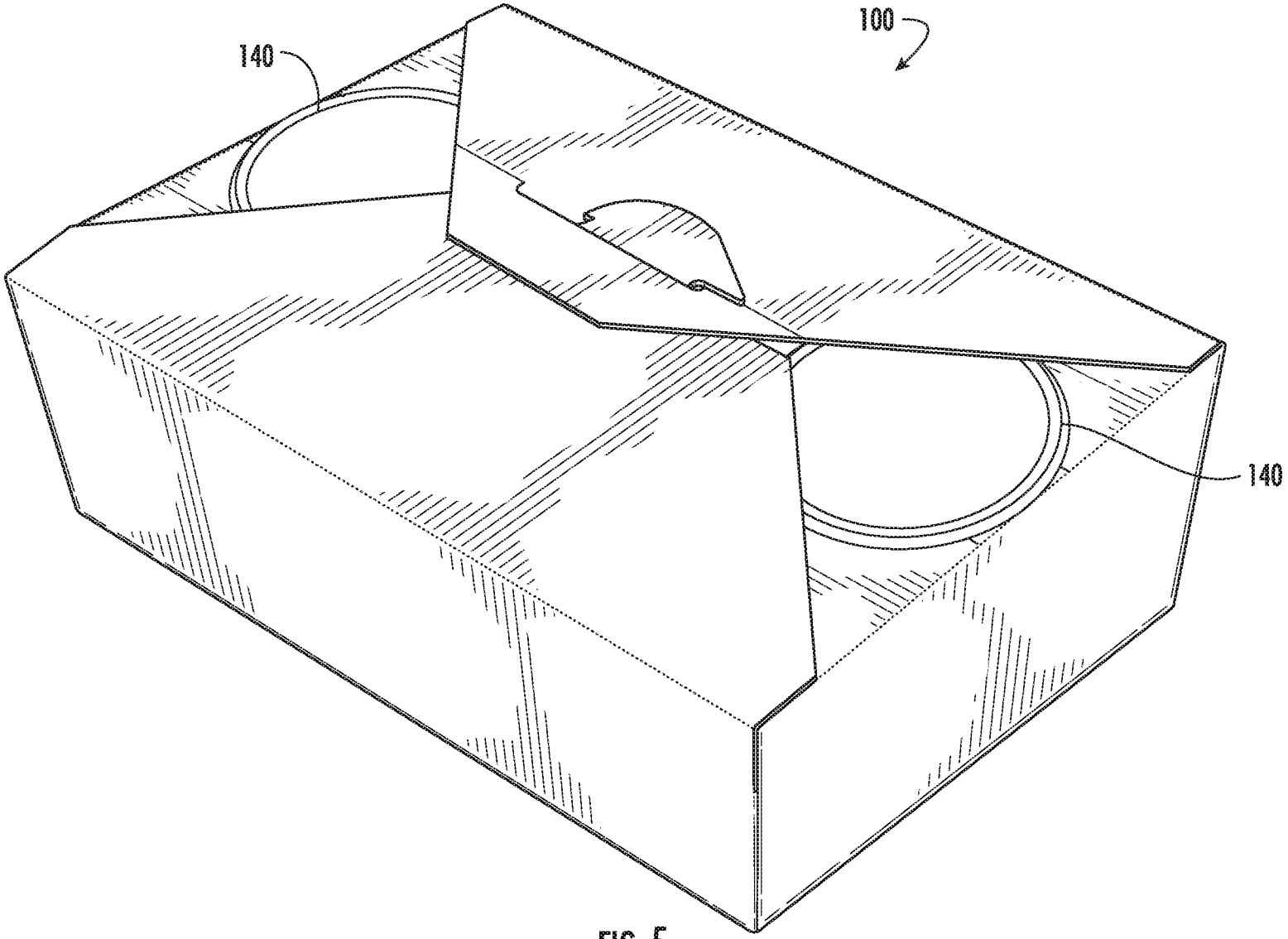
Figure 6:
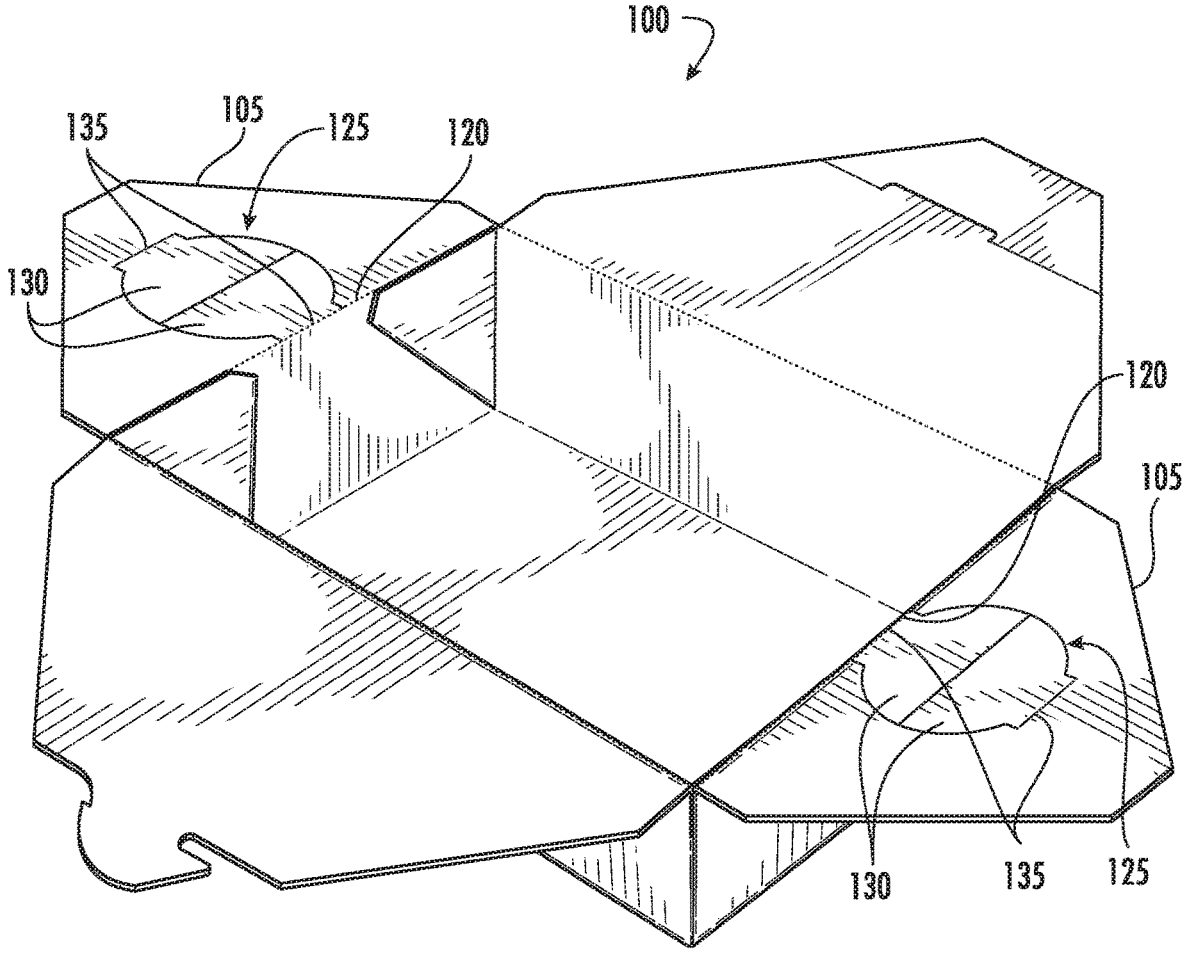
Figure 7:
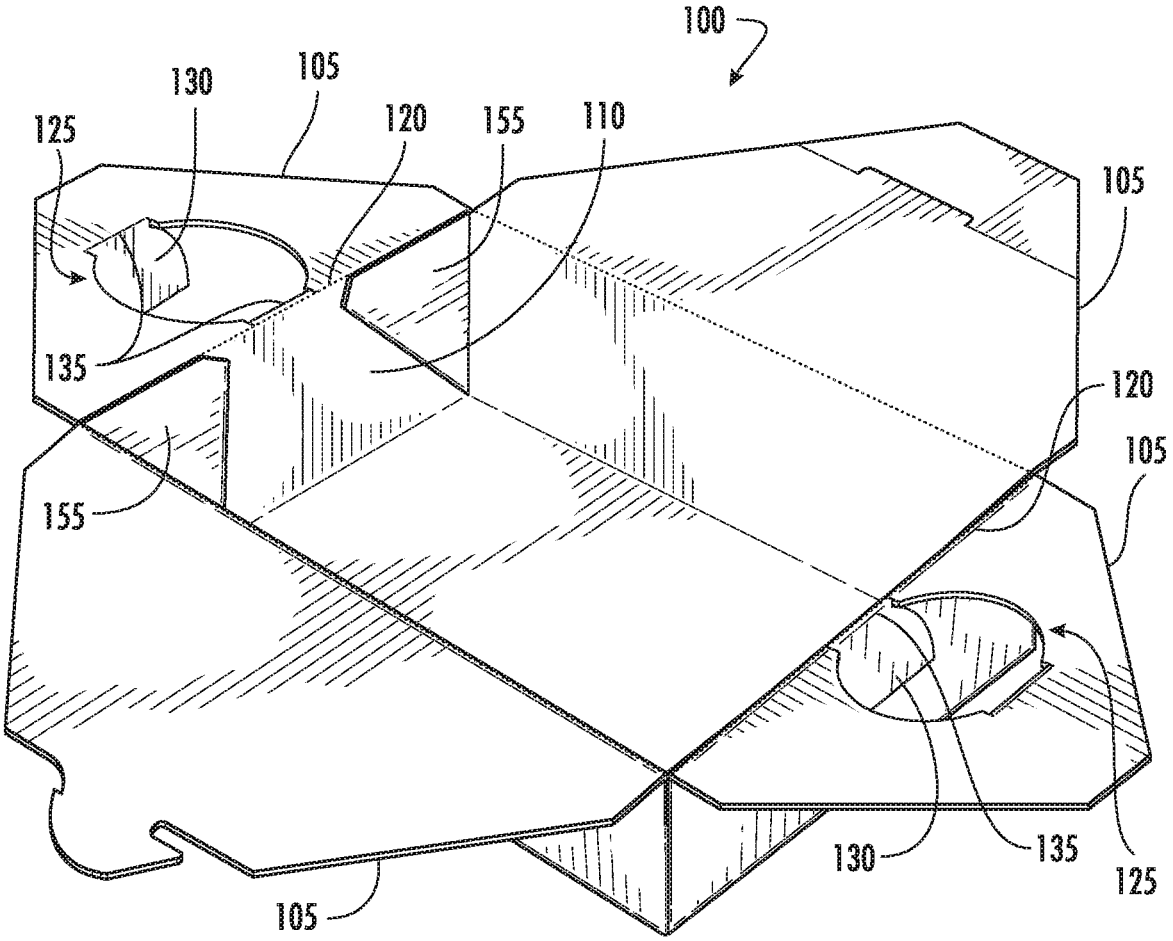
Figure 8:
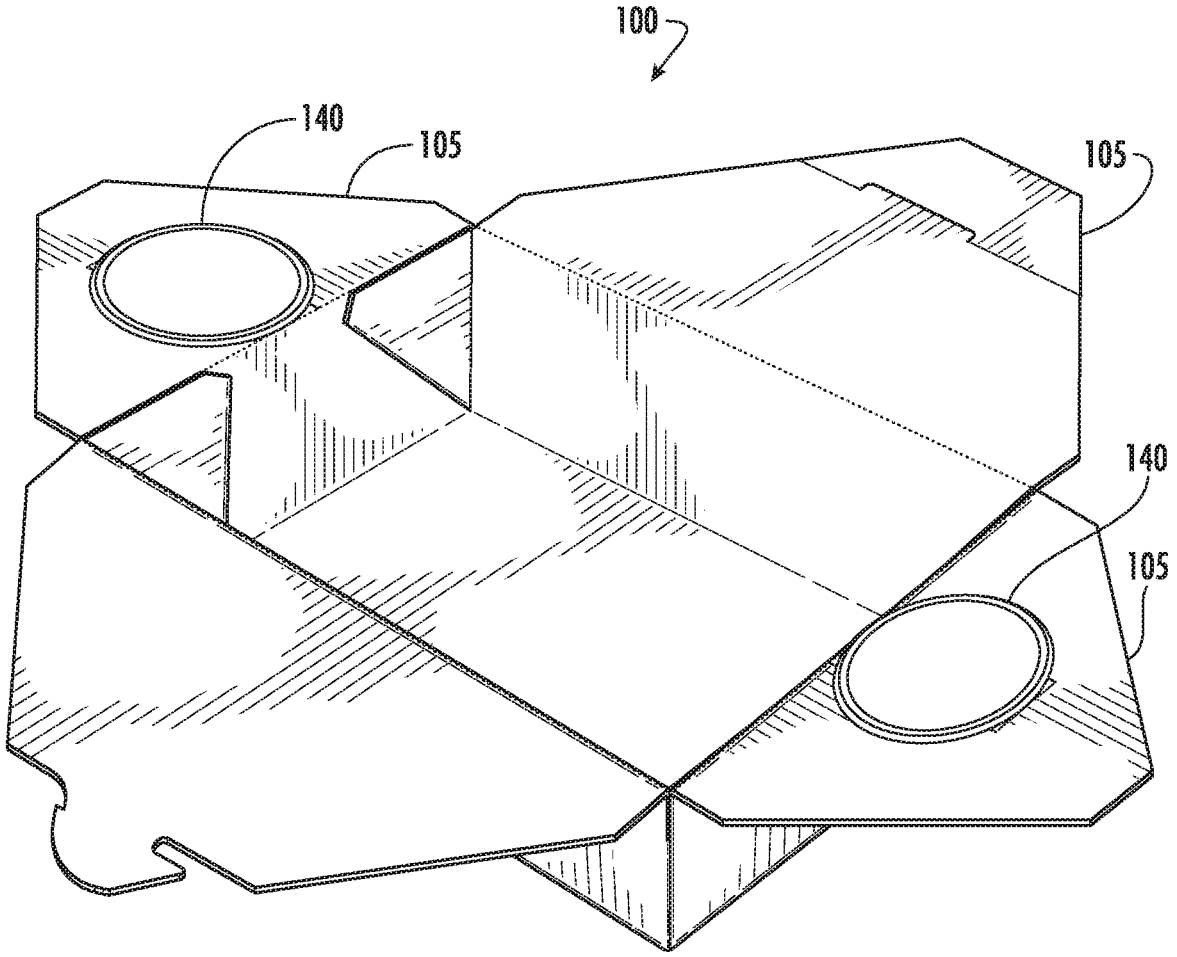
Figure 9:
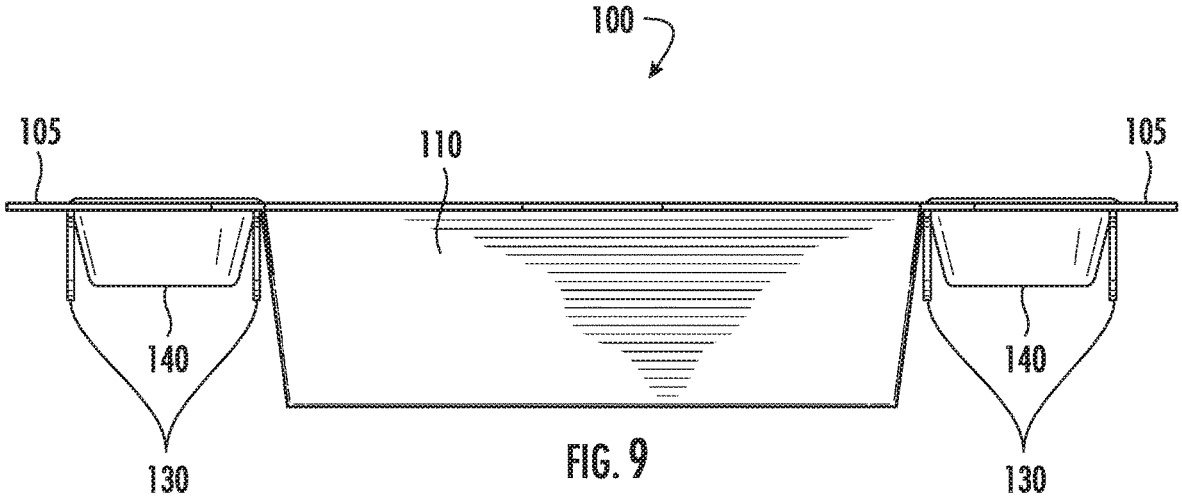
Figure 10:
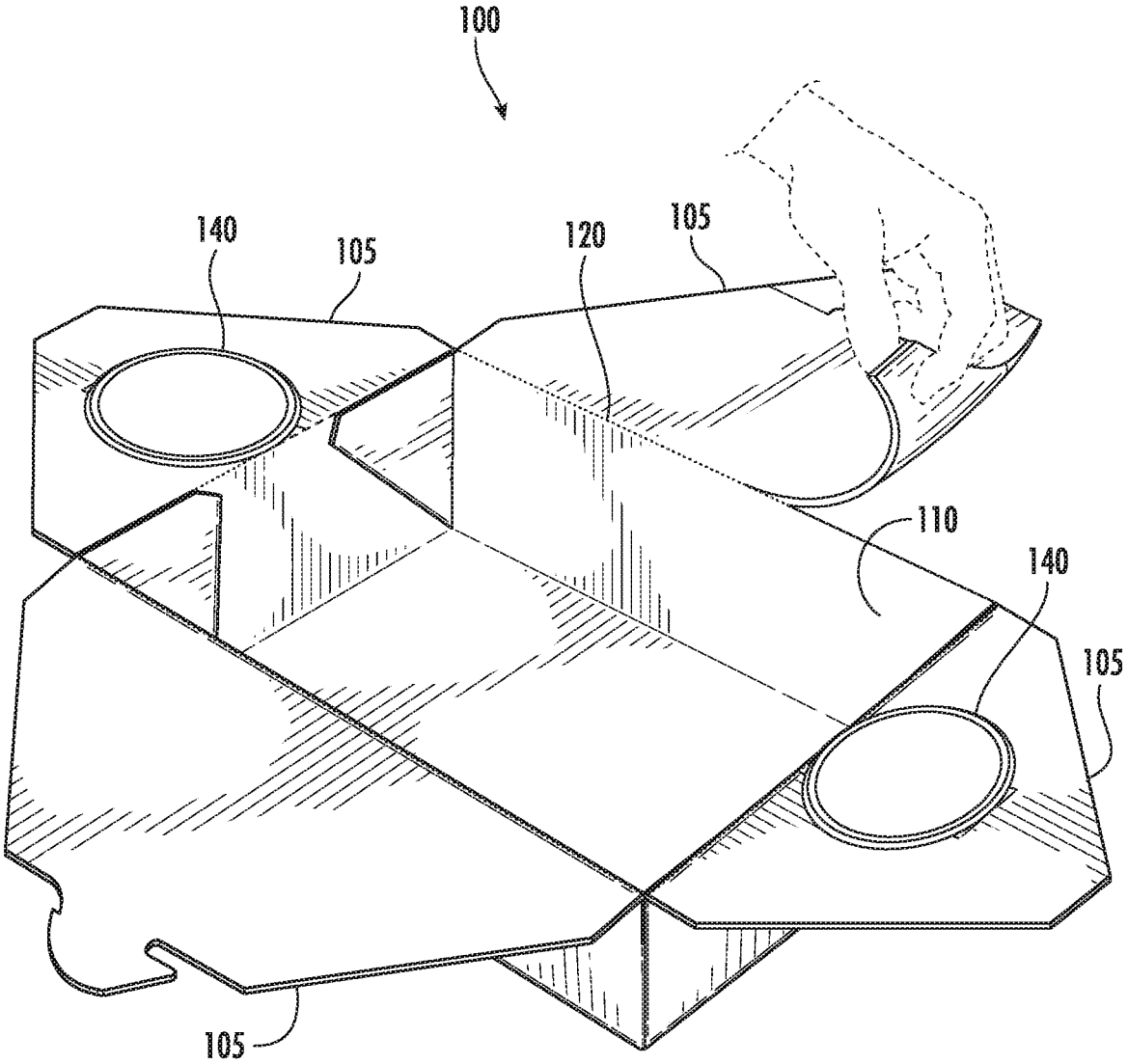
Figure 11:
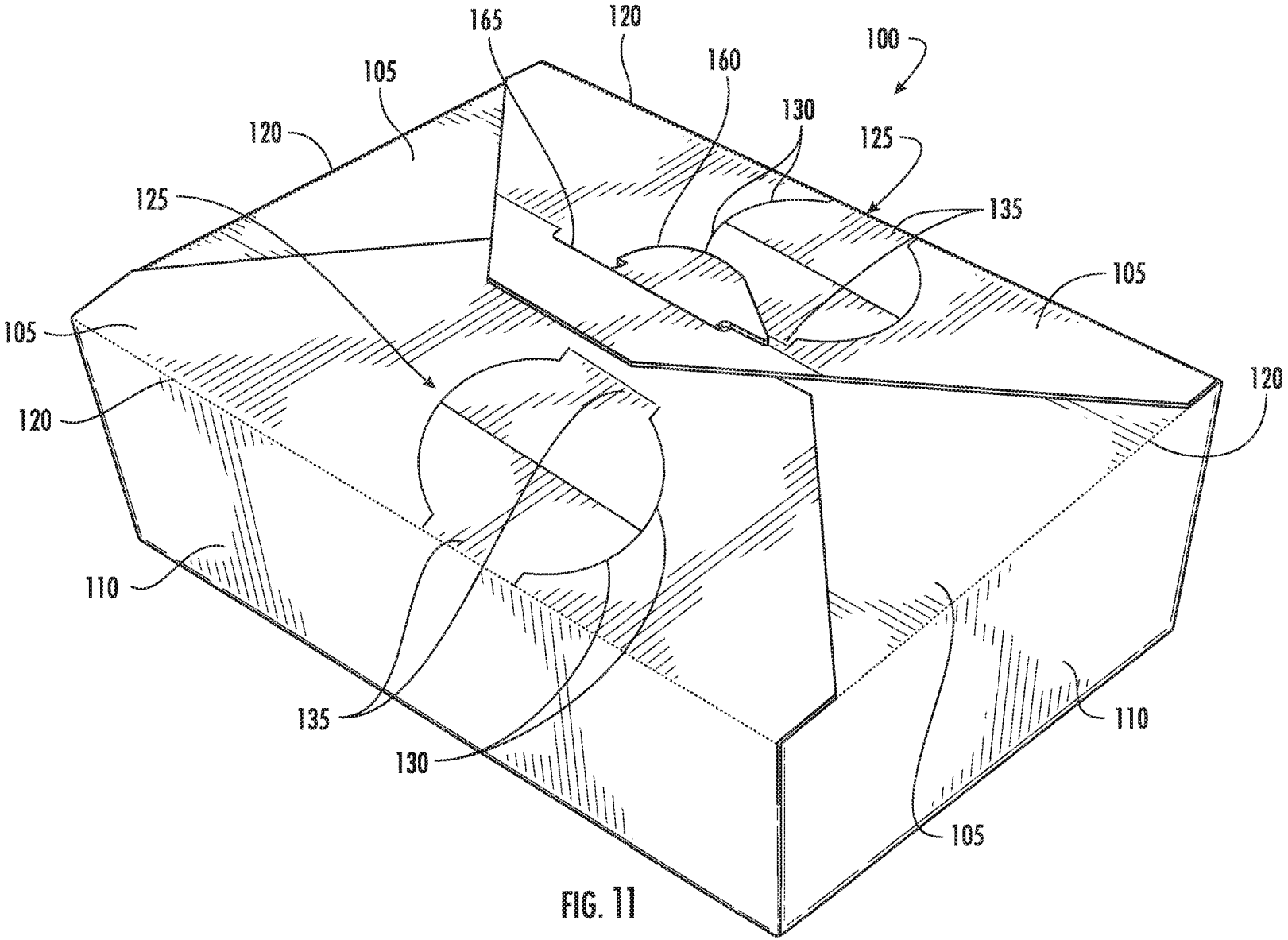
Figure 12:
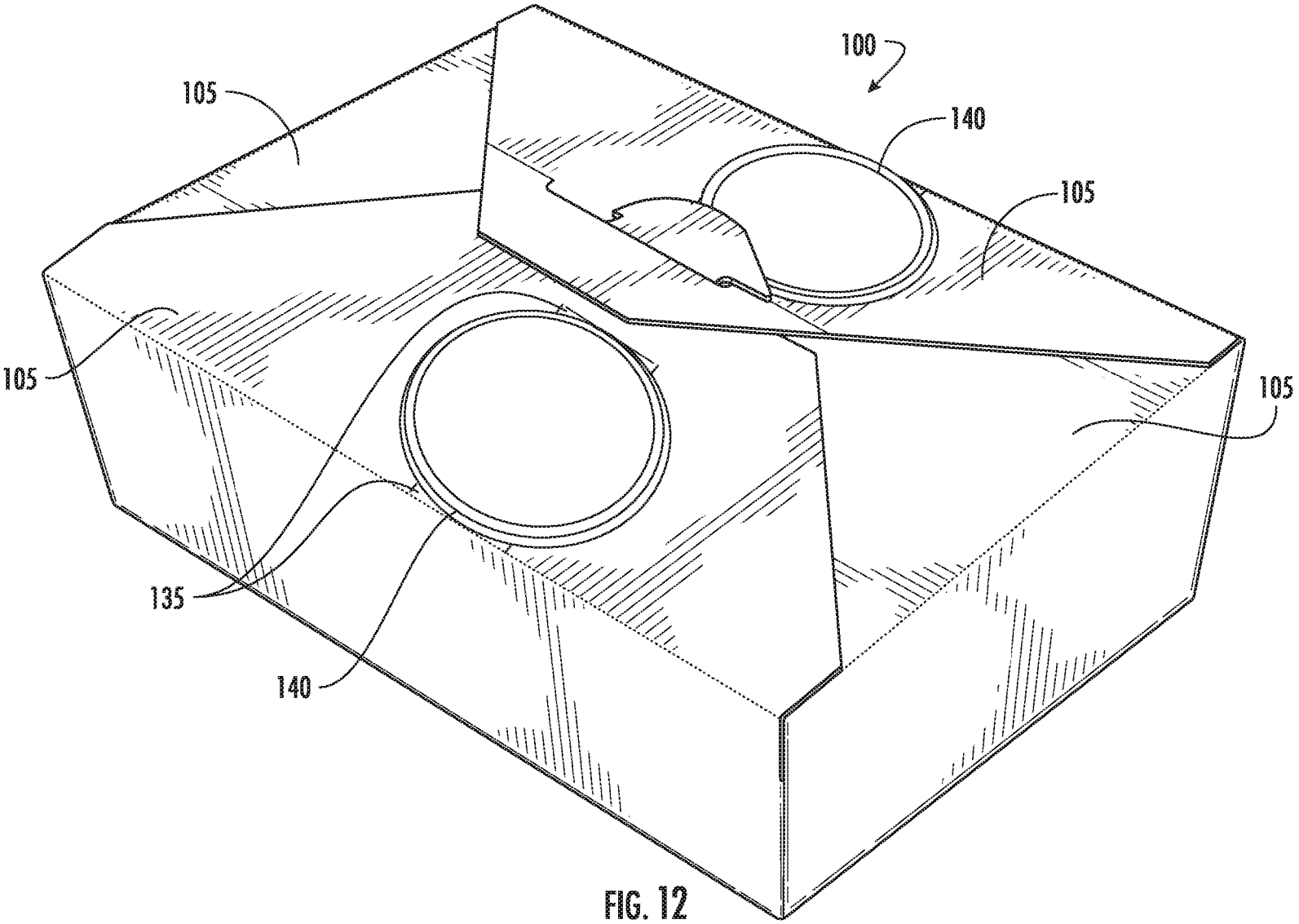
Figure 13:
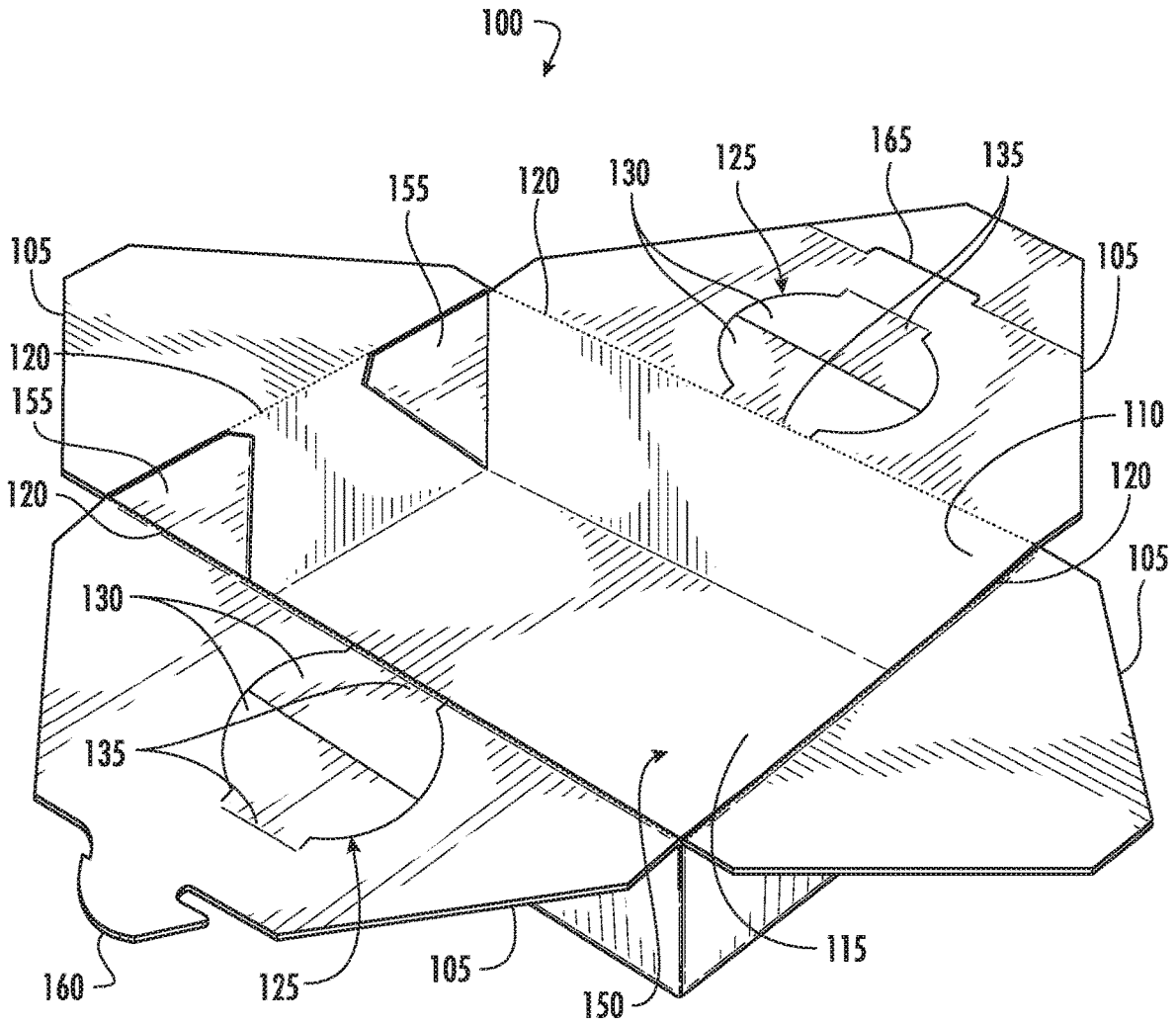
Figure 14:
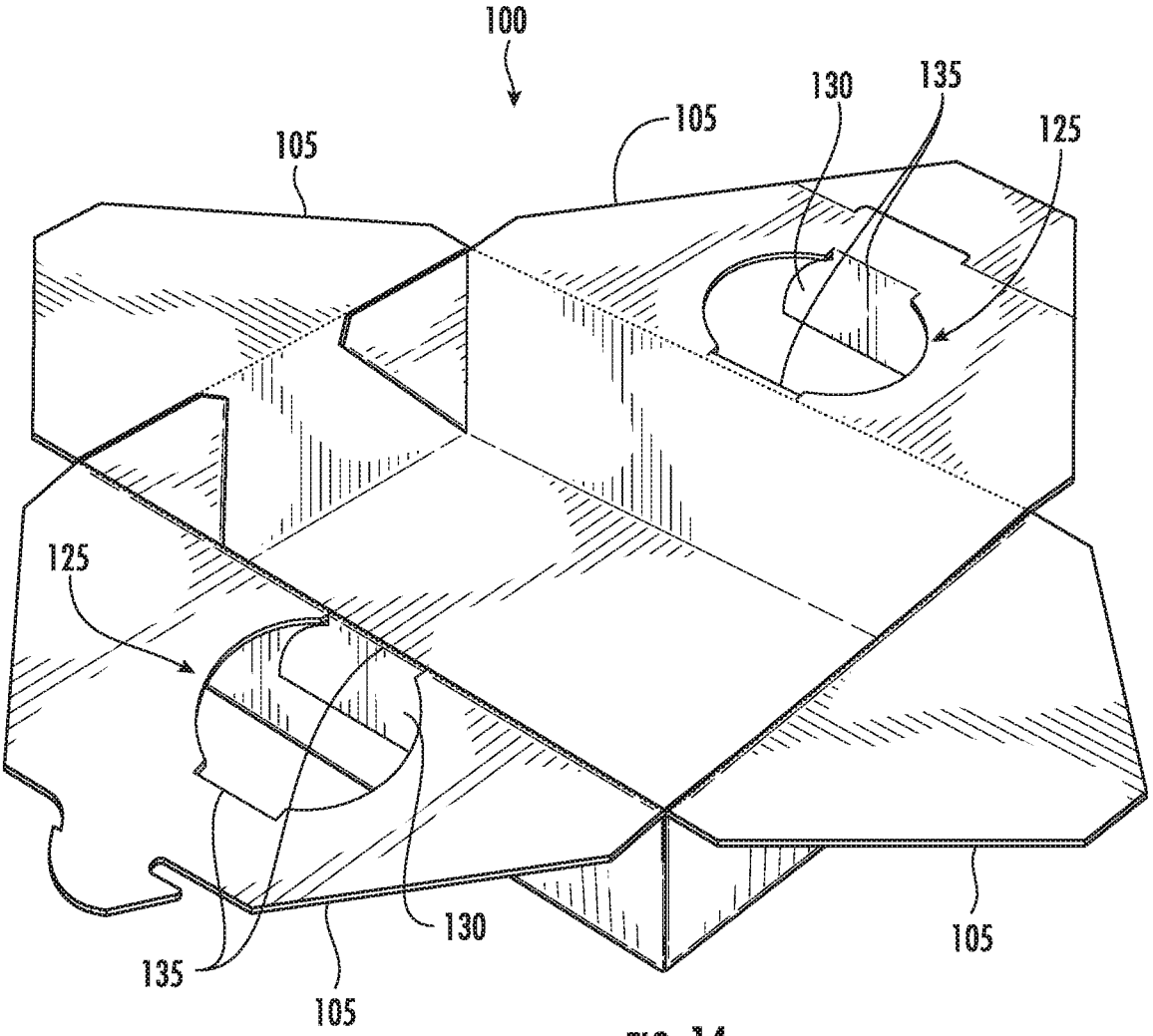
Figure 15:
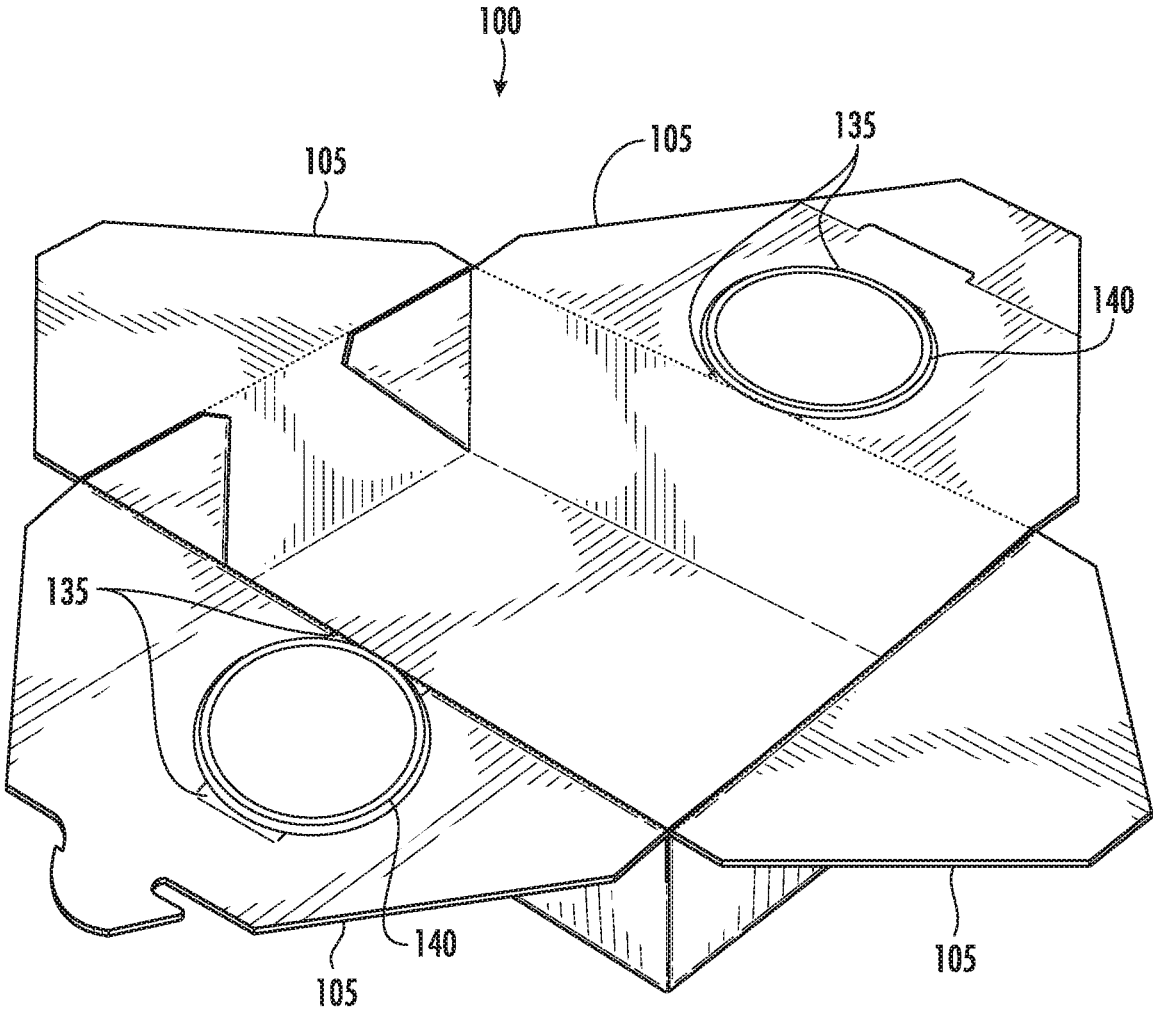
Figure 16:
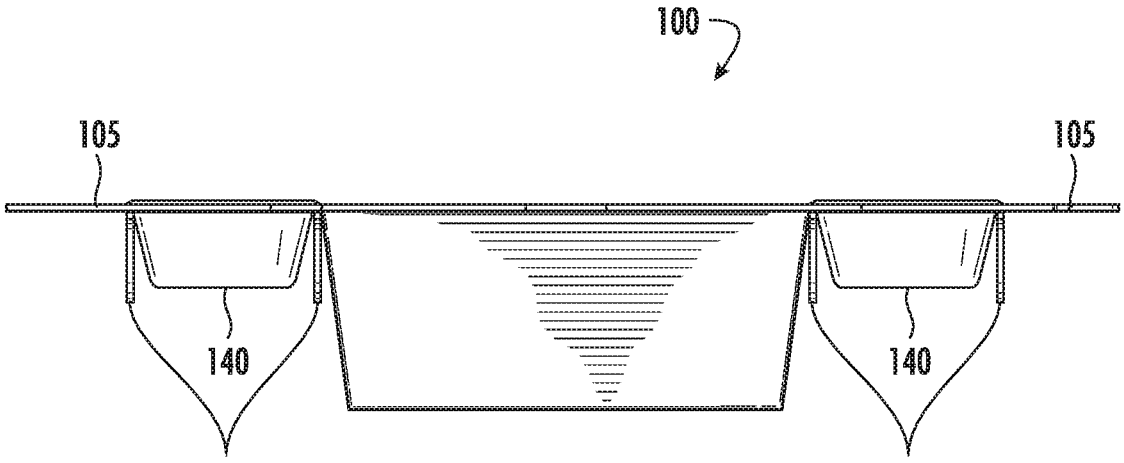
Figure 17:
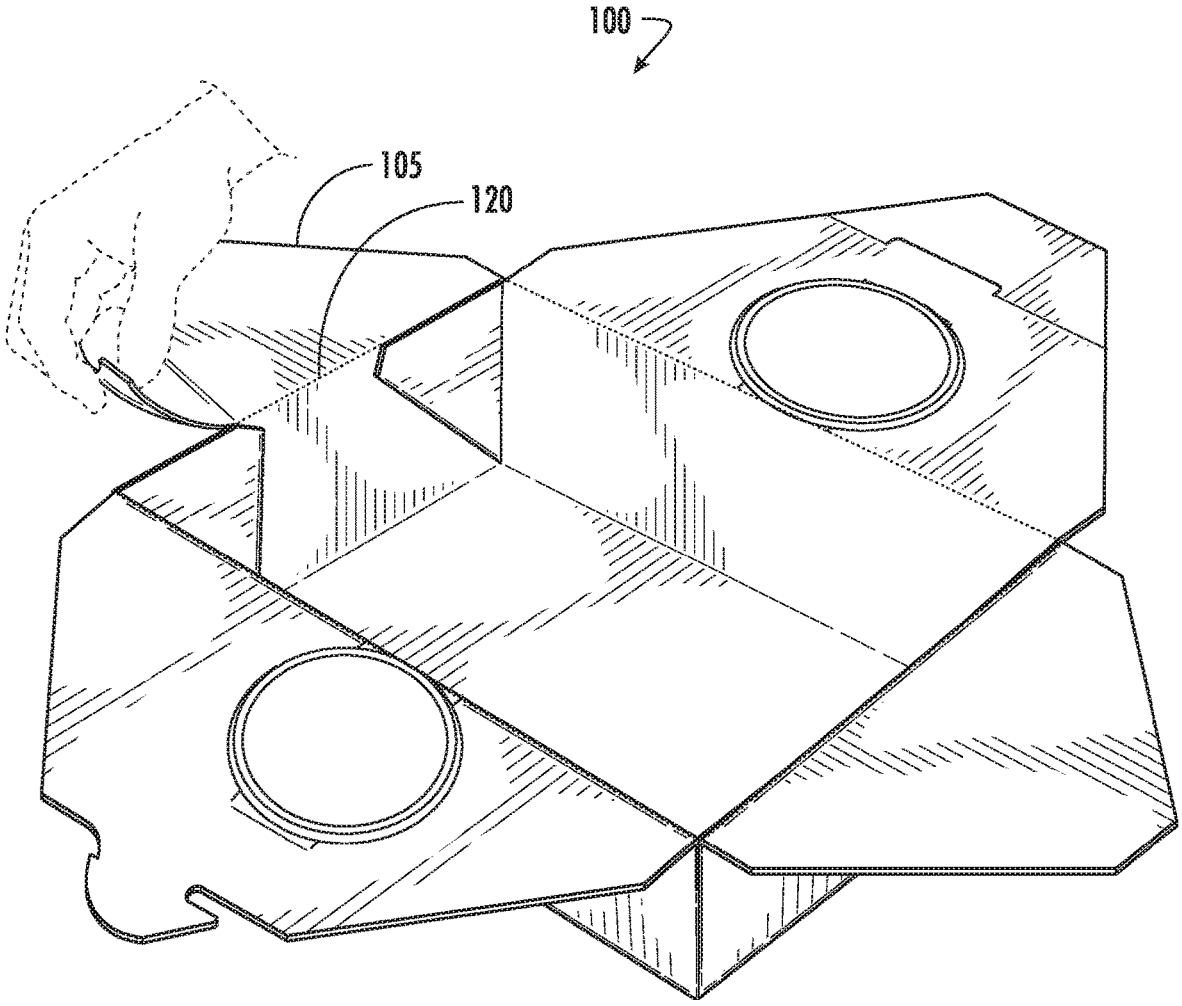
Figure 18:
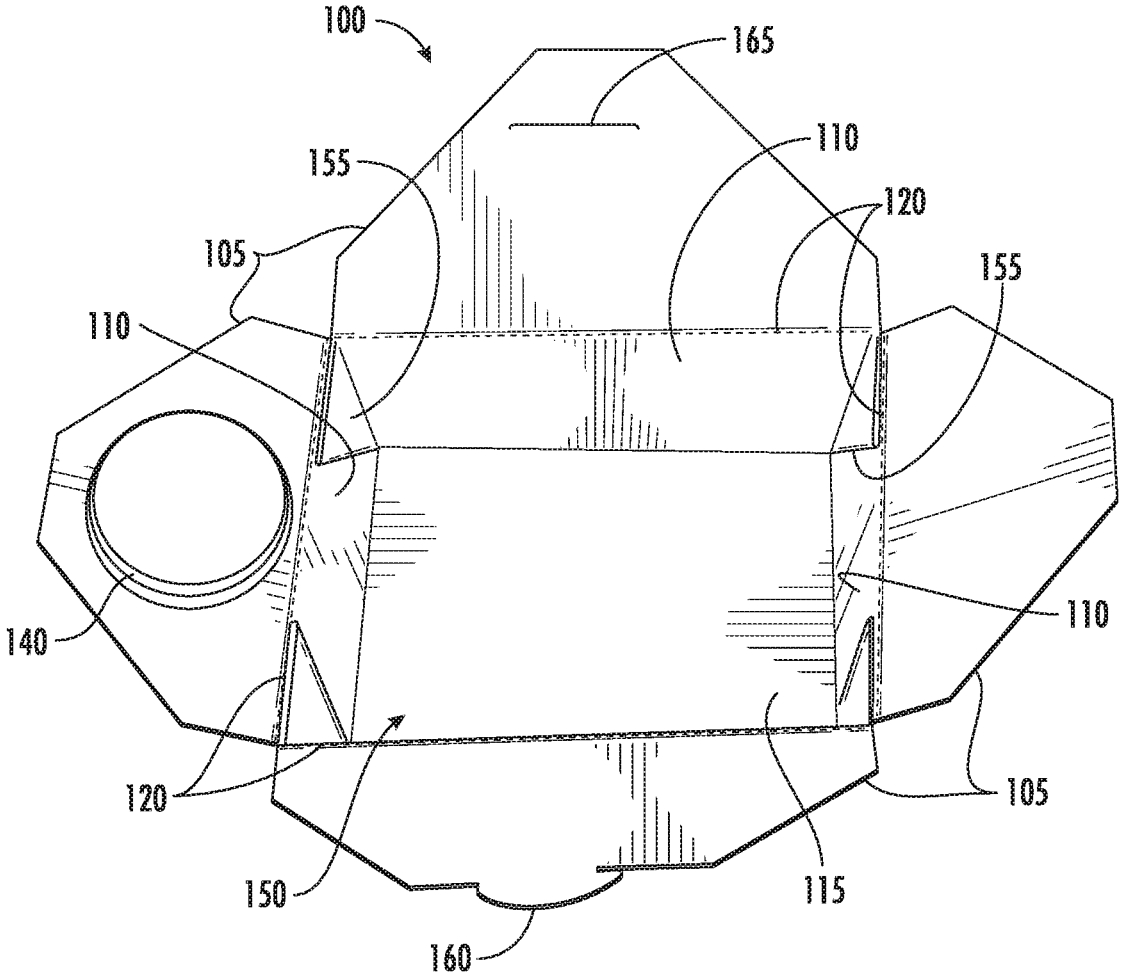
Figure 19:
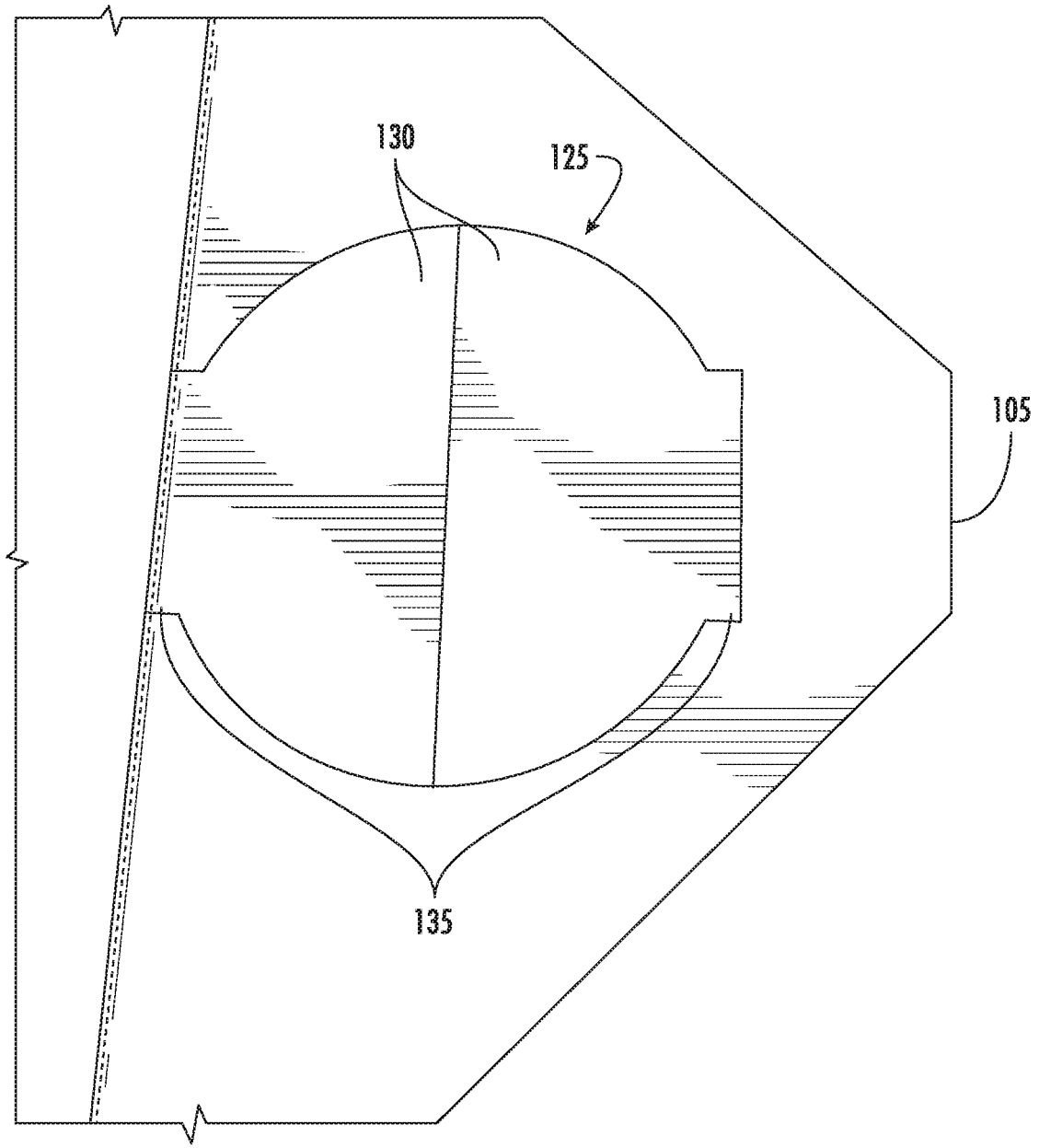
Figure 20:
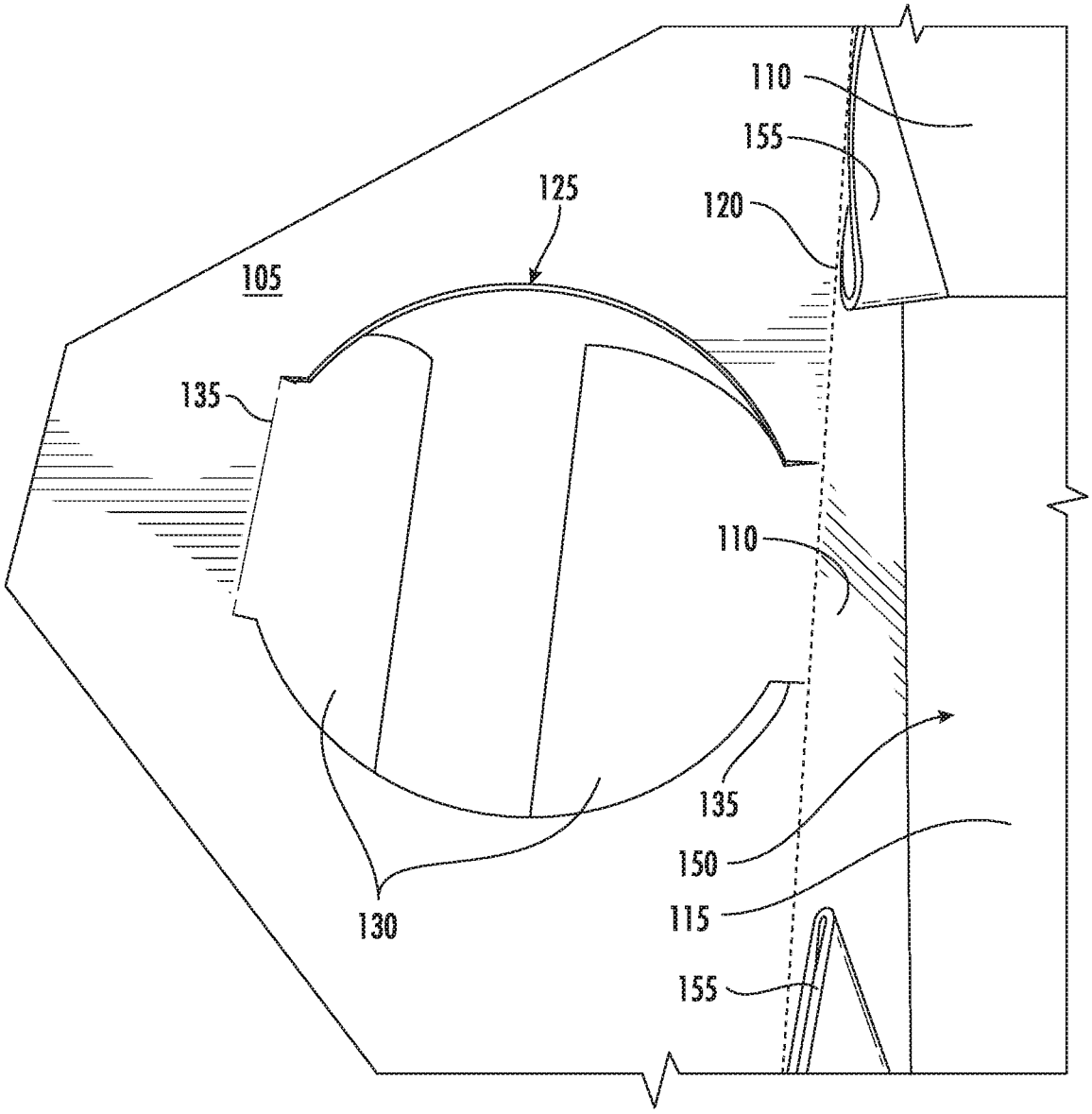
Figure 21:
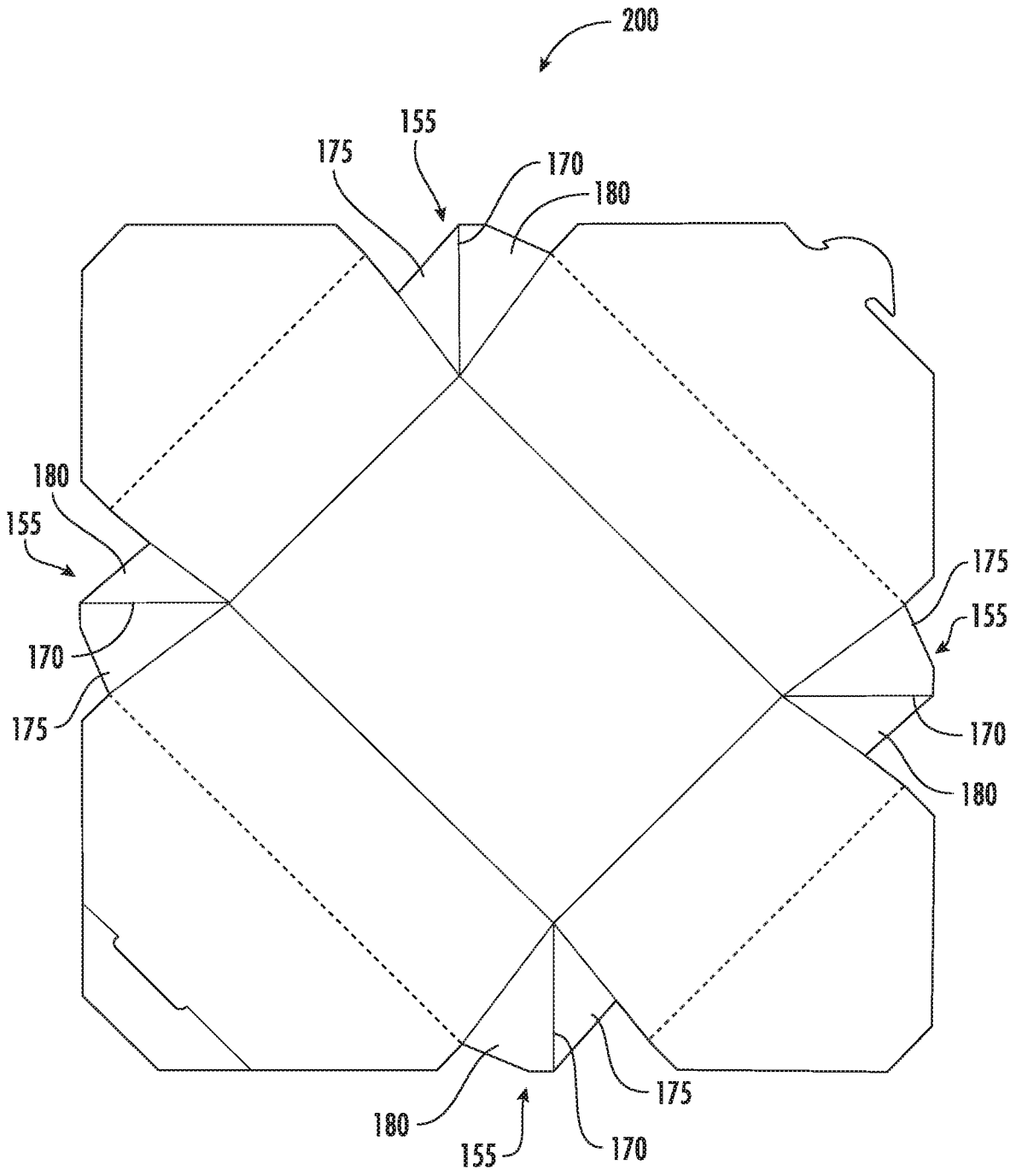

Having thus described the presently disclosed subject matter in general terms, reference will now be made to the accompanying Drawings, which are not necessarily drawn to scale, and wherein:

FIG. 1 illustrates a perspective view of a food carton with removable flaps in accordance with an embodiment of the invention;

FIG. 2 illustrates a top plan view of the food carton of FIG. 1 in an open configuration;

FIG. 3 illustrates a perspective view of a user in the process of removing a removable flap of the food carton of FIG. 1;

FIG. 4 illustrates a perspective view of a food carton with removable flaps and portion cup punch-outs in accordance with another embodiment of the invention;

FIG. 5 illustrates another perspective view of the food carton of FIG. 4 with portion cups inserted in the portion cup punch-outs;

FIG. 6 illustrates a perspective view of the food carton of FIG. 4 in an open configuration;

FIG. 7 illustrates another perspective view of the food carton of FIG. 6 with portion cup punch-outs in an open position;

FIG. 8 illustrates another perspective view of the food carton of FIG. 7 with portion cups inserted in the portion cup punch-outs;

FIG. 9 illustrates a front side view of the food carton of FIG. 8;

FIG. 10 illustrates a perspective view of a user in the process of removing a removable flap of the food carton of FIG. 8;

FIG. 11 illustrates a perspective view of the food carton with removable flaps and portion cup punch-outs in accordance with another embodiment of the invention;

FIG. 12 illustrates another perspective view of the food carton of FIG. 11 with portion cups inserted in the portion cup punch-outs;

FIG. 13 illustrates a perspective view of the food carton of FIG. 11 in an open configuration;

FIG. 14 illustrates another perspective view of the food carton of FIG. 13 with portion cup punch-outs in an open position;

FIG. 15 illustrates another perspective view of the food carton of FIG. 14 with portion cups inserted in the portion cup punch-outs;

FIG. 16 illustrates a front side view of the food carton of FIG. 15;

FIG. 17 illustrates a perspective view of a user in the process of removing a removable flap of the food carton of FIG. 15;

FIG. 18 illustrates a perspective view of the food carton with a single portion cup inserted in the portion cup punch-out in accordance with another embodiment of the invention;

FIG. 19 illustrates a top close up view of one of the removable flaps of the food carton with a portion cup punch-out;

FIG. 20 illustrates a top close up view of one of the removable flaps of the food carton with a portion cup punch-out in an open position; and FIG. 21 illustrates the food carton of FIG. 1 in a blank configuration.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

The present invention includes a food carton with one or more removable closure flaps, and may further include one or more portion cup punch-outs formed in the one or more closure flaps.

Referring now to the drawings, which show various views of example embodiments of the presently disclosed food carton 100. Food carton 100 may be a foldable style carton, and may be suitable for housing food items therein. In an unassembled/unfolded state carton 100 may be substantially flat (see for example blank 200 in FIG. 21). Carton 100 may be shipped and stored as blank 200, e.g., in its unassembled/unfolded (substantially flat) state, for ease and more efficient transportation and storage. Prior to use, carton 100 may be folded from its unassembled blank 200 state into its assembled state as carton 100 suitable for holding items, such as food items, for example take-out or deli style food items. Food carton 100, in its assembled state, may be of a number of overall general shapes including, but not limited to, square, rectangular, pyramidal, triangular, circular, oval, or any other suitable shape.

In one embodiment, food carton 100 may include closure flaps 105, side panels 110, and a bottom panel 115. In one embodiment, closure flaps 105 may extend from top edges of side panels 110; and bottom panel 115 may be attached about its periphery to bottom edges of side panels 110. Food carton 100, may further include corner gussets 155 extending between and connecting adjacent side panels 110, wherein the side panels 110, bottom panel 115, and corner gussets 155, when in a folded assembled state form an inner compartment region 150, for example for holding food items.

In one embodiment, one or more of joints 120 are formed where closure flaps 105 meet the top edge of their respective side panels 110. In one embodiment, one or more of the closure flaps 105 may be removable from the top edge of side panel 110 at its respective joint 120. In one example, joints 120 may be perforated to facilitate removal of one or more of the closure flaps 105. Alternatively, joints 120 may be scored, laser cut, embossed, or weakened in any other suitable manner to facilitate the removal of the closure flap 105 from the top edge of side panel 110, for example by a user pulling on the closure flap 105 (See FIGS. 3, 10, and 17).

Closure flaps 105, may be folded inward and downwardly into a position above and substantially parallel with bottom panel 115 to close food carton 100. One or more of closure flaps 105, may be adapted to engage with one another or with a side panel 110 to secure the food carton 100 in a closed position. In one example, one closure flap 105 may interlock with an opposing closure flap 105 via a tab 160 formed on one of closure flaps 105 and a corresponding slot 165 formed in the opposing closure flap 105.

Food Carton 100 may further include one or more portion cup punch-outs 125. Portion cup punch-outs 125 may be formed in one or more of the closure flaps 105. In one embodiment, portion cup punch-outs 125 are disposed in one or both of a left and right side closure flaps 105. Alternatively, portion cup punch-outs 125 may be formed in one or both of a front and back side closure flaps 105, or in any one or more of closure flaps 105. Further, there may be more than one portion cup punch-out 125 in any one or more of the closure flaps 105. In one embodiment, portion cup punch-outs 125 may be generally circular in shape, or may be any other suitable shape, including but not limited to, square, rectangular, oval, or other suitable shape Portion cup punch-outs 125 maybe formed, for example, as two abutting generally half circles 130. A portion of the outer peripheral edge of the two half circles 130 may each be connected to closure flap 105 by a tab 135. The remaining portion of the outer peripheral edge of the two half circles 130 and the abutting portions of the two half circles 130 may be free to move, or alternatively may be perforated or otherwise weekend to allow for the two half circles 130 to easily fold upward, downward, and/or be removed, with application of a small amount of force, e.g., from a user pressing thereon. Alternatively, portion cup punch-outs 125 may be formed in any other suitable manner, such as formed as two abutting half-ovals, half-rectangles, half-squares, half triangles, and/or the like. Alternatively, portion cup punch-outs 125 may be a single unitary removable piece, of any suitable shape, and/or may be attached to the closure flap 105 only along a single side edge or portion of the portion cup punch-outs 125, thus allowing the portion cup punch-outs 125 to fold upward or downward along the attached side edge or portion. In another embodiment, portion cup punch-outs 125 may be made of the same material as that of closure flaps 105, or may be made of different material, e.g., a plastic film, or any other suitable material. In still yet another alternative embodiment, portion cup punch-outs 125 may be a defined hole in one or more of the closure flaps 105, that is, in such an embodiment there is no material forming the portion cup punch-outs 125.

Portion cup punch-outs 125 may be sized and shaped, and otherwise configured to hold a portion cup 140 therein. For example, portion cup punch-outs 125 may be sized and shaped to accept various standard sized portion cups, for example a two (2) ounce circular shaped portion cup. In other embodiments the portion cup punch-outs 125 may be sized and shaped to accommodate and hold portion cups 140 of other sizes/shapes, for example, but not limited to standard size portions cups smaller or larger than two (2) oz. In one non-limiting example portion cup punch-out 125 may be generally circular and have a diameter of about 2 1/16 inches. Portion cup punch-outs 125 may be sized and configured such that a lid of the portion cup 140, set therein, may be removed by a user while the portion cup 140 is still retained in the portion cup punch-out 125. In such an embodiment, the diameter of the portion cup punch-out is smaller than the diameter of the upper most edge of the portion cup 140 (without its lid), but larger than a bottom portion of the portion cup 140. Portion cup 140 may be, in one non-limiting example, a condiment cup, and may be used to hold a sauce, dip, dressing, side item, garnish, topping, or the like for a food item contained in the food carton 100.

In one embodiment, for example, when portion cup punch-outs 125 are disposed in one or both of the left and right side closure flaps 105, the front and rear closure flaps 105, when in a closed position, may overlap at least a portion of one or more of the portion cups 140 inserted in the portion cup punch-outs 125 (See, for example FIG. 5). In such an embodiment, the front and rear closure flaps 105 help to hold the inserted portion cups 140 in place in the portion cup punch-outs 125.

Inner compartment region 150, may be of a generally trapezoidal shape. Inner compartment region 150, in one embodiment, may be for holding/storing a food item (or items) therein, and may include a coating, such as a food grade grease-resistant coating, for example, to protect the food carton 100 from degradation due to moisture, grease, etc. from food placed therein. In one example, inner compartment region 150 may be defined by a generally square or rectangular shaped bottom panel 115 and four side panels 110. Adjacent side panels 110 may be connected to one another by corner gussets 155. Each corner gusset 155 may be unitary with its adjacent side panels 110. In a folded assembled state, corner gussets 155 may be folded and secured to an interior surface of a corresponding adjacent side panel 110. In one embodiment, corner gusset 155 may be secured to its corresponding adjacent side panel 110 by an adhesive (e.g., heat resistant adhesive), thermal bonding, or any other suitable technique or mechanism.

Side panels 110 may be disposed at an obtuse angle as measured from the bottom panel 115 to form, in one example, a trapezoidal-like inner compartment region 150, wherein the inner compartment region 150 of food carton 100 tapers from its top edge to its bottom edge, wherein, the side walls 110 are wider at their top edge than at their bottom edge.

Food carton 100 may be formed from a single unitary blank 200 (as shown for example in FIG. 21). In one example, blank 200 may be formed from a single sheet of paperboard or other material suitable for one or more of holding, heating (reheating), and cooking food. Blank 200 may alternatively be formed of any type of suitable material, and preferably of a material that can withstand the heat generated in a microwave or other type of oven or heating/reheating device. Blank 200 may have a planar, unitary construction and in one example may be generally square or rectangular in overall geometry. Blank 200 has an interior side which contacts the contents of food products placed in the inner compartment region 150 of an assembled food carton 100, and an exterior side. Blank 200 may also have edges which define outer boundaries, and score lines that hingedly connect adjacent panels to facilitate folding blank 200 into assembled food carton 100. Blank 200 may further include bottom panel 115 characterized by a generally square or rectangular shape. Side panels 100 may be contiguous with and hingedly connected to their respective side edge of bottom panel 115. Top edge of each of side panels 110 may be substantially parallel with their corresponding bottom edge, and the left and right side of each of side panels 110 may diverge from their corresponding bottom edge at a defined obtuse angle (e.g., greater than 90). Corner gussets 155 may be formed between adjacent side panels 110. When opposing side panels 110 are folded substantially upright, inner compartment region 150 is formed and, as shown in, for example, FIGS. 2 and 3, foldable gussets 155 may be folded against an interior surface of its adjacent side panel 110 and secured thereto. Alternatively, foldable gussets 155 may be folded against an exterior portion of its adjacent side panels 110 and secured thereto. Side panels 110 may be positioned upright at the defined obtuse angle measured with respect to bottom panel 115. Corner gussets 155 may be contiguous with their respective adjacent side panels 110 and may include a fold line 170, which divides the foldable gusset 155 into a first gusset panel 175 and second gusset panel 180.

In one embodiment, when assembling food carton 100 from blank 200, side panels 110 may be folded upright to form a generally box like configuration. As side panels 110 are folded upright corner gussets 155 may be folded inward along fold line 170. To secure food carton 100 in its folded assembled state, corner gussets 155 may be folded over, such that an inner surface of either of the first gusset panel 175 or second gusset panel 180 comes into contact with the inner surface of its adjacent side panel 110. The first gusset panel 175, or second gusset panel 180, as applicable, is then adhered or bonded to its corresponding adjacent side panel 110. In an alternative embodiment, when assembling food carton 100 from blank 200, the corner gussets may be folded outward along fold line 170, and folded over, such that one of an outer surface of either of the first gusset panel 175 or second gusset panel 180, as applicable, comes into contact with an outer surface of its adjacent side panel 110, and then adhered or bonded thereto.

In one embodiment, the interior surface of the food carton 100 may be coated with a heat sealable coating, such as a food grade heat sealable coating, and instead of applying glue or other adhesive between the inside surface of the first gusset panel 175, or second gusset panel 180, as applicable, and the overlapped area of its adjacent side panel 110; once the inside facing surface of the first gusset panel 175, or second gusset panel 180, as applicable, is folded over to be in contact with the inside surface of its adjacent side panel 110 it may be heat sealed by applying heat to the folded area and causing the heat sealable coating to bond the inside facing surface of the first gusset panel 175, or second gusset panel 180, as applicable, to the inside surface of its adjacent side panel 110. This may be repeated for all four corners of the food carton 100, or done for two (2) or more corners simultaneously.

In use, blank 200 is folded into an assembled food carton 100. A food item (or items) may be placed in the inner compartment region 150. One or more portion cups 140 may be inserted in one or more of portion cup punch-outs 125. Closure flaps 105 may be folded to a closed position and secured in the closed position. In the closed position one or more of the closure flaps 105 may overlap a portion of the inserted portion cups 140, thereby helping to secure the portion cups 140 in place.

A consumer receiving the food carton 100, with food placed therein, may then open one or more of the closure flaps 105 to access the food item. In one example, the consumer may first open the closure flaps 105 that overlap a portion of the one or more portion cups 140, then remove the one or more portion cups 140 from their respective portion cup punch-outs 125 of corresponding closure flaps 105, and then open the remaining closure flaps 105 to access the food item in the inner compartment region 150. Once the one or more portion cups 140 are removed, and all the closure flaps 105 are open, the consumer may optionally reinsert the one or more portion cups 140 into portion cup punch-outs 125 through the underside of the corresponding closure flaps 105, the bottom side of the closure flaps now facing upward in their open position (See for example FIGS. 6-9 and 13-16). The consumer may, as shown for example in FIGS. 3, 10, and 17, remove one or more of closure flaps 105 along corresponding joints 120 to make the food item contained in the inner compartment region 150 easier to access and consume. Alternatively, the consumer may elect to simply remove the one or more portion cups 140 from their respective portion cup punch-outs 125 and place them on a table or other surface without reinserting them into their respective portion cup punch-outs 125 once the closure flaps 105 are opened. Additionally, the consumer may also elect to not remove any of the closure flaps 105.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A carton, comprising:

a. a bottom panel;

b. side panels extending about a periphery of the bottom panel;

c. corner gussets extending between adjacent side panels, wherein the bottom panel, side panels, and corner gussets are configurable to form a compartment region;

d. one or more closure flaps extending from an uppermost edge of one or more of the side panels forming a moveable joint where the closure flap and corresponding side panel intersect, wherein one or more of the moveable joints are weakened, and wherein one or more of the one or more closure flaps are configured to be removable from its respective side panel by tearing along a respective one of the weakened moveable joints.

2. The carton of claim 1, further comprising one or more punch-out regions formed in one or more of the one or more closure flaps.

3. The carton of claim 2, wherein the punch-out region is sized and configured to accept and retain a portion cup therein.

4. The carton of claim 2, wherein the punch-out region is general circular in shape.

5. The carton of claim 2, wherein the punch-out region comprises a moveable or removable portion to allow for insertion of a portion cup into the punch-out region.

6. The carton of claim 2, wherein the punch-out region comprises two semicircle portions abutting each other along a straight edge of their respective semicircles, and each of the two semicircles having a portion thereof attached to the closure flap, wherein one or both of the two semicircle portions are configured to be at least one of moved or removed to allow for insertion of a portion cup into the punch-out region.

7. The carton of claim 1, wherein one or more of the moveable joints comprise perforations.

8. The carton of claim 1, wherein the one or more closure flaps are configured to fold inward and downwardly into a position above and substantially parallel with the bottom panel to close the carton.

9. The carton of claim 8, wherein at least two of the one or more closure flaps are adapted to engage with one another when in a folded closed position.

10. The carton of claim 9, wherein the at least two closure flaps are opposing closure flaps and are configured to interlock with one another via a tab formed on one of the at least two closure flaps and a corresponding slot formed in the other of the at least two closure flaps.

11. The carton of claim 8, wherein closure flaps are configured such that when in a closed position one or more of the one or more closure flaps overlap at least a portion of a portion cup inserted in one or more of the one or more portion cup punch-outs.

12. The carton of claim 1, wherein the compartment region comprises a generally trapezoidal shape.

13. The carton of claim 1, wherein an inner surface of the compartment region comprises a coating.

14. The carton of claim 13, wherein the coating comprises a food grade plastic coating.

15. The carton of claim 13, wherein the coating comprises a heat sealable coating.

16. The carton of claim 15, wherein the corner gussets are secured to the inner surface of their corresponding adjacent side panels by applying heat to the region where the corner gussets overlap with their corresponding adjacent side panels.

17. The carton of claim 1, wherein the corner gussets are configured to be foldable and securable to an inner surface of one of their adjacent side panels, wherein securing the corner gussets to their corresponding adjacent side panels secures the compartment region in its formed state.

18. The carton of claim 1, wherein the corner gussets are secured to the inner surface of one of their adjacent side panels by at least one of adhesive and thermal bonding.

19. The carton of claim 1, wherein the side panels are disposed at an obtuse angle as measured from the bottom panel, and wherein the side walls taper along a left and right side edge of the side walls from their top edge to their bottom edge.

* * * * *